US012599271B2

(12) United States Patent
Chakravorty

(10) Patent No.: US 12,599,271 B2
(45) Date of Patent: Apr. 14, 2026

(54) HYGIENIC AND CONTROLLED FABRIC WEB DISPENSING SYSTEM

(71) Applicant: Shyamal Chakravorty, Mclean, VA (US)

(72) Inventor: Shyamal Chakravorty, Mclean, VA (US)

( * ) Notice: Subject to any disclaimer, the term of this patent is extended or adjusted under 35 U.S.C. 154(b) by 385 days.

(21) Appl. No.: 18/469,255

(22) Filed: Sep. 18, 2023

(65) Prior Publication Data

US 2025/0089950 A1 Mar. 20, 2025

(51) Int. Cl.
*A47K 10/36* (2006.01)
*A47K 10/32* (2006.01)

(52) U.S. Cl.
CPC ..... *A47K 10/36* (2013.01); *A47K 10/32* (2013.01); *A47K 2010/3233* (2013.01)

(58) Field of Classification Search
CPC ..... A47K 10/32; A47K 10/36
See application file for complete search history.

(56) References Cited

U.S. PATENT DOCUMENTS

| | | | | |
|---|---|---|---|---|
| 2,474,672 | A | 6/1949 | Hill | |
| 3,606,407 | A | 9/1971 | Pendergast | |
| 4,235,389 | A | 11/1980 | Ness | |
| 4,398,310 | A | 8/1983 | Lienhard | |
| 4,406,421 | A | 9/1983 | Schultz et al. | |
| 4,662,578 | A | 5/1987 | Chakravorty | |
| 4,666,099 | A | 5/1987 | Hoffman et al. | |
| 4,738,176 | A | 4/1988 | Cassia | |
| 4,765,555 | A | 8/1988 | Gambino | |
| 4,790,490 | A | 12/1988 | Chakravorty | |
| 4,796,825 | A | 1/1989 | Hawkins | |
| 4,826,262 | A | 5/1989 | Hartman et al. | |
| 4,944,464 | A | 7/1990 | Zelenka | |
| 4,960,248 | A | 10/1990 | Bauer et al. | |
| 5,060,323 | A | 10/1991 | Shaw | |
| 5,217,035 | A | 6/1993 | Van Marcke | |
| 5,294,192 | A | 3/1994 | Omdoll et al. | |
| 5,452,832 | A | 9/1995 | Niada | |
| 2020/0096154 | A1* | 3/2020 | Paré | A47K 10/22 |
| 2022/0087487 | A1* | 3/2022 | Bagherzadeh | A47K 10/3836 |
| 2022/0206138 | A1* | 6/2022 | Murphy | G01D 11/24 |
| 2023/0284841 | A1* | 9/2023 | Laitala | A47K 10/3687 |
| 2024/0041270 | A1* | 2/2024 | Robertson | A47K 10/3687 |
| 2024/0237861 | A1* | 7/2024 | Keller | A47K 10/46 |
| 2024/0292982 | A1* | 9/2024 | Lewis | A47K 10/38 |
| 2025/0344912 | A1* | 11/2025 | Liuzzo | A47K 10/32 |

* cited by examiner

*Primary Examiner* — Gene O Crawford
*Assistant Examiner* — Ayodeji T Ojofeitimi

(57) ABSTRACT

Described is a mechanical device designed to hygienically store and dispense tearable dry or wet fabric such as bathroom tissue, paper towel, medical gauze, and other. The dispenser system comprises an airtight encasement with a release gear mechanism which is activated by hands-on mechanical way. The gear mechanism is connected to the fabric roll axle and thus regulates the release of the fabric web. The dispensing system, in activated mode, allows free passage of the fabric web out of the dispenser through an opening but in the released mode, locks up the fabric web with a tight prong device in the opening prohibiting the dispensed web from further movement and thus ready for tearing. The dispenser housing is provided with a movable top cover for installing the fabric roll and its manual dispensing when needed. The cover comprises a tray installed on it for placement of gadgets and daily essentials.

8 Claims, 33 Drawing Sheets

HYGIENIC AND CONTROLLED FABRIC WEB DISPENSING SYSTEM

SUMMARY OF THE INVENTION

The present invention relates to controlled dispensing of flexible sheet material, also called fabric or fabric web in this application, from its roll housed in an airtight hygienic encasement. In particular, the present invention relates to multiple features that may be advantageously used by themselves or in conjunction with each other, for the dispensing of web products, e.g., paper towels, paper tissue, medical gauze and the like in a residential, commercial, or institutional facility. A gravity-actuated gear train system coupled with fabric web catch and tearing system and methods in accordance with this invention may be usefully applied in virtually any application where it is desired to dispense thin, tearable material sheets specifically in public and medical settings. The invention described herein advances other dispensing inventions from this and other authors cross-referenced above.

BACKGROUND AND PURPOSE OF THE INVENTION

In recent years, infectious intracellular viruses and unicellular bacteria have sickened or killed millions of people around the world through direct human contact or via indirect contact with materials and devices of daily use, especially in public places such as offices, airports, shops, restaurants, hospitals, medical clinics, public bathrooms, and many other facilities. These viruses and bacteria have become more common and deadlier with time as has been recognized by the spread of the Covid-19 variants. In the coming years, these viruses are expected to become yet more common and major health risk. There is thus a need for greater infection protection through advanced hygienic tools more than are available today. The purpose of this invention is therefore to deliver a hygienic solution by providing storage and dispensing of fabric for cleaning and drying body and device parts, the fabric being encased in air-tight housing, free from harmful viruses and bacteria, and requires no human touch until the fabric web is released for use in a controlled manner. This invention thus reduces the transmission of viruses and bacteria to the greatest extent feasible.

Most fabric dispensers such as paper towel or tissue dispensers found in public facilities are not totally encased. They have fabric release openings that are always open and therefore they are not infection protective systems. Additionally, most such dispensers need tough fabric sheets, or perforated sheets, that often cause fabric wastage especially when not all of the dispensed sheet, or the full length of the dispensed sheet or web, is required for use. Even those dispensers that have sensor-actuated delivery mechanism, the fabric is delivered piecemeal in equal length, irrespective of the extent of fabric needed thereby causing repeated wastage with every use. In this latter category, the fabric is generally thicker and tougher than tissue paper for instance and does not lend itself to effective tearing and efficient usage. Not only that, uneven tearing or partial dispensing of the web tends to give the impression to the follow-on users that the dispensed web is soiled and unhygienic, so they simply discard the dispensed web causing yet more fabric wastage.

The two earlier patented designs from this author referred to above, also do not provide effective dispensing as their performance rapidly degrades with time especially for large dispensers. Both designs have delivery gear mechanism working against the force of gravity in that the door plate opens and closes in the vertical plane. With time, the spring holding the door weakens, thereby permanently keeping the door slightly open which exposes the fabric to infection. Additionally, the door loses its tight grip on the dispensed web making its proper tear unsuccessful.

The dispenser design illustrated in this application overcomes these shortcomings through a horizontal spring loaded door system, the door comprising vertical jaws of teeth and a horizontal plane blade that tightly clasp the fabric web, the web being pulled over the blade's sharp edge and efficiently torn. This delivery mechanism is not constraining to fabric's air-tight hygienic housing and size, its user-controlled dispensing, and variations in its tenacity. Such effective dispensing systems are not available to this date. The earlier inventions did not provide hygienic efficacy combined with the robustness of efficient dispensing for different fabric materials.

Described thus is a mechanical system designed to hygienically store and dispense fabric of desired size such as the paper tissue, towel, medical gauze, film sheet, or similar other tearable material, susceptible to transmission of viruses or bacteria through their use. The fabric in this device is stored totally encased and its dispensing does not require direct human contact with the fabric web prior to it being dispensed.

BRIEF DESCRIPTION OF THE DRAWINGS

Various other objects, features and attendant advantages of the present invention will become fully appreciated as the same becomes better understood when considered in conjunction with the accompanying drawings in which like reference characters designate the same or similar parts throughout the dispenser system's several views, which are further expounded for assembly and operation in detail in the section below titled Detailed Description Of The Preferred Embodiment Of The Invention, and so annotated here below:

FIG. 73 is an elevation view from the square pin end of the bottom half of shaft a.

DETAILED DESCRIPTION OF THE PREFERRED EMBODIMENT OF THE INVENTION

Although the disclosure hereof is detailed and exact to enable those skilled in the art to practice the invention, the physical embodiments herein disclosed merely exemplify the invention which may be embodied in other specific structures. The description of the embodiment of the dispenser system along with its parts and related assemblies with their nomenclature, so as to be illustrative and at the same time be clearly expounding the individual or assembled construct characteristics and functions as applicable, is provided in the enumerated paragraphs here below. The operational details of the dispenser follow thereafter.

Figure 1:
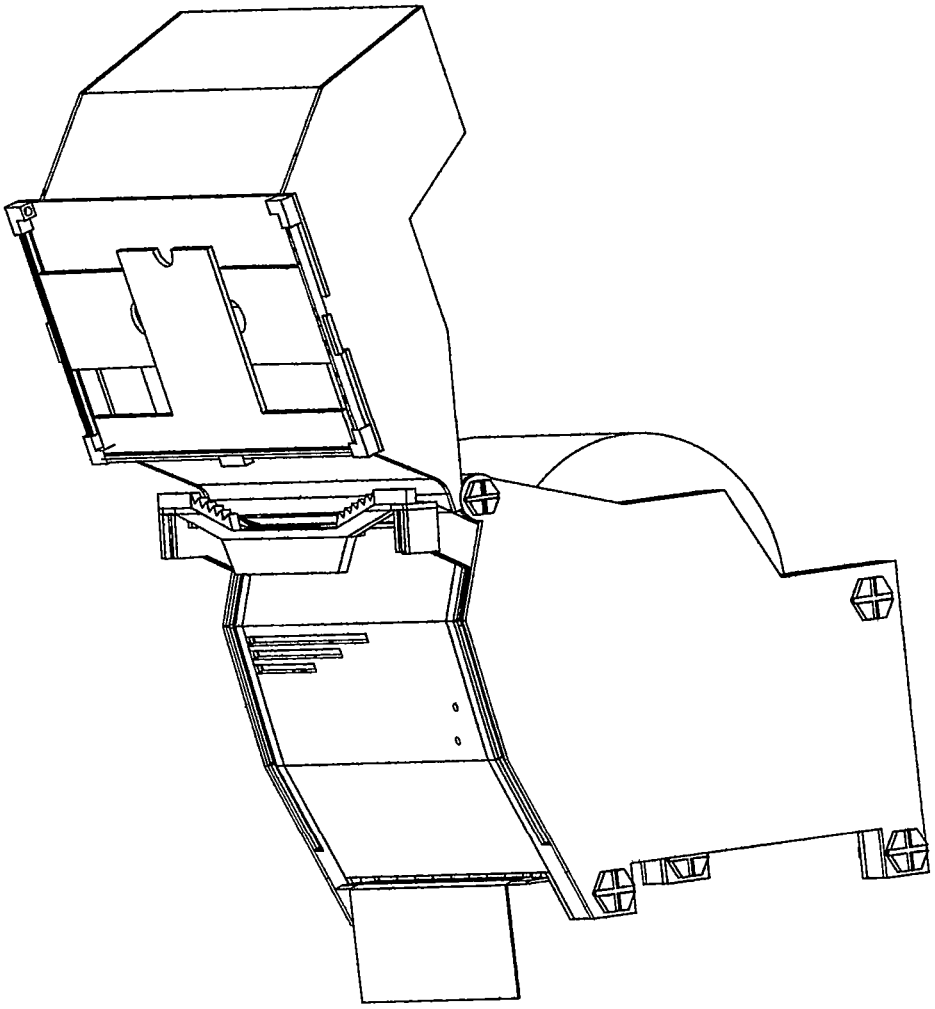
FIG. 1 is an isometric view of the partially open dispenser system.
Figure 2:
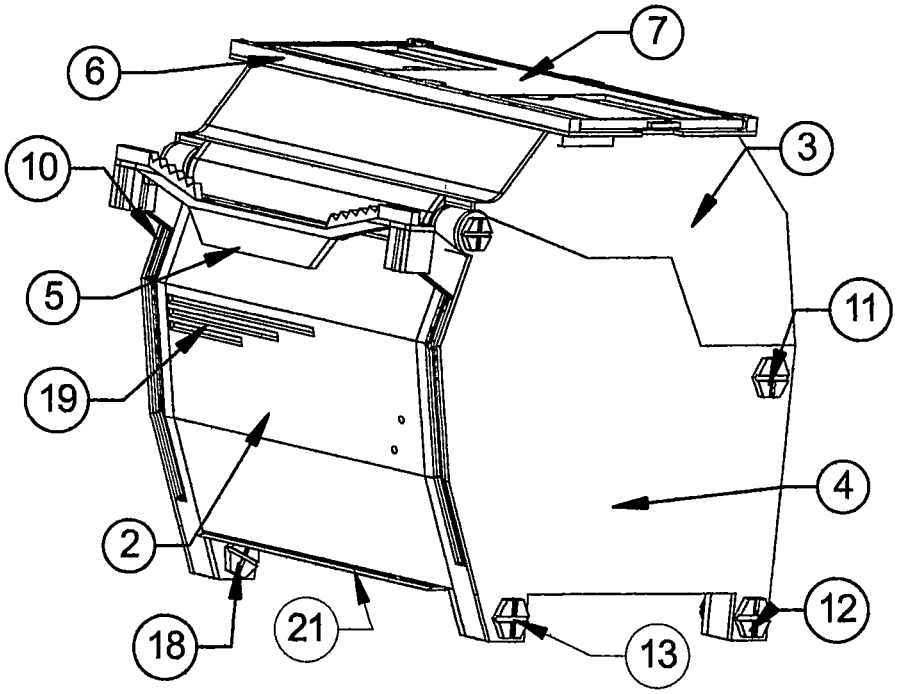
FIG. 2 is a front perspective view of the closed dispenser.
Figure 3:
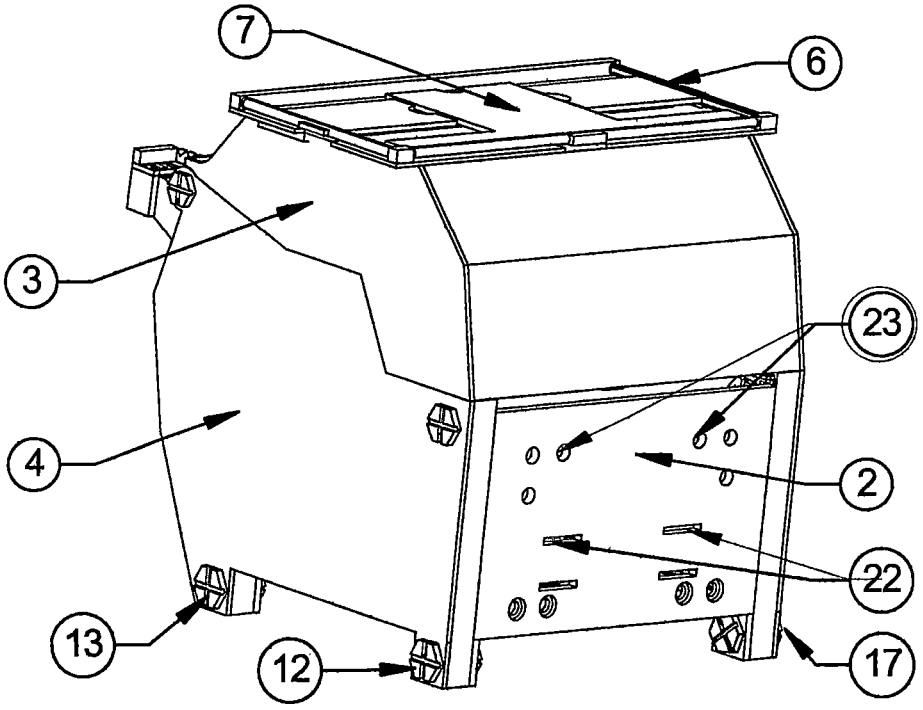
FIG. 3 is a rear perspective view of the dispenser.

1. Dispenser Assembly: FIGS. 1-3 three views of the dispenser system, which is also referred to as dispenser and dispenser assembly in this application, are presented in FIGS. 1-3, wherein FIG. 1 illustrates fully assembled dispenser 1 that is partly open, housing the fabric roll, embodying the front and side body frame, front handle, extended slider edge. FIG. 2 illustrates a perspective view of the front of dispenser 1, and FIG. 3, the perspective view of the back of dispenser 1. FIG. 2 further illustrates multiple parts to include top cover 3, right exterior sidewall 4, also called right exterior wall 4, front handle 5, top tray 6 including its central cover plate 7, right exterior wall 4 attachment nut-screw pairs 11, 12 and 13, and front handle 5 right end attachment nut 14. Similar nut-screw pairs 16, 17 and 18 are needed to attach left exterior sidewall 8, also called left exterior wall 8, to frame 2 as shown in FIG. 3 and described here below. However, all the left and right exterior walls' attachment nut-screw pairs are not needed if the exterior walls 4 and 8 are built as integral parts of frame 2. On the left and right sides of the front of dispenser 1 are two openings 9 and 10 that run almost the full vertical length of the front of walls 4 and 8 illustrated in FIG. 2. A number of elongated grooves 19 and holes 20, as needed for mounting product insignia or other similar purposes, are identified on the front face of frame 2 as illustrated in FIG. 2. Grooves 19 and holes 20 are not essential for the operation or the construction of dispenser 1 or any of its parts. In FIG. 2, at the bottom of the front of frame 2, is shown blade 21 which is used for tearing off the dispensed fabric as described in the dispenser operation text below.

The front face of frame 2 can be vertically straight, curved, or geometrically shaped, the latter was selected for a proof-concept-design for this patent and as such is shown in FIG. 2. This design of front face of frame 2 is therefore left to the technical and business decisions of the manufacturer so long as the design does not interfere with free dispensing of the fabric from the fabric roll.

FIG. 3 shows multiple identical horizontal rectangular openings or slits 22 of desirable design length, width, and orientation. Slits 22 are meant to hold sloped support 307 using its inserts 311 which are later identified in FIGS. 81 and 82. This backwall of frame 2 also includes multiple holes 23 which are meant for inserting nails or screws, not shown in this patent application, for mounting the dispenser system 1 on to a wall or board as needed.

Figure 4:
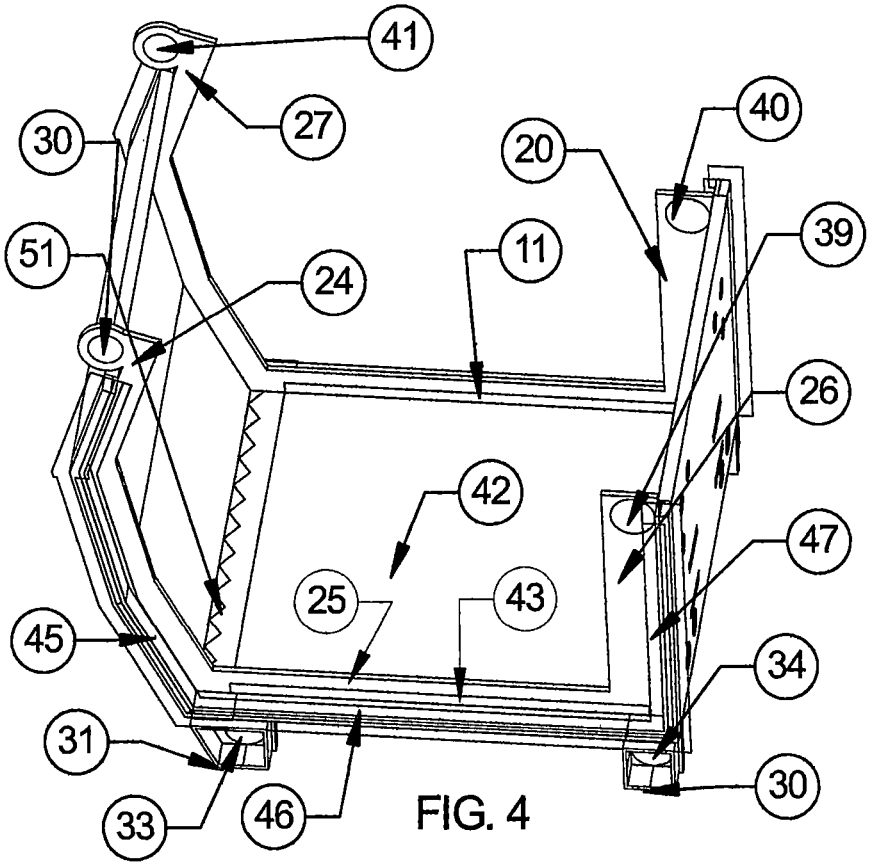
FIG. 4 is a perspective view of the base frame.

2. Dispenser Frame: FIGS. 4-9 illustrate dispenser frame 2 and associated various parts. FIG. 4 provides a perspective view of the basic structure of frame 2 which comprises a contiguous narrow side support wall 24-26 on the right side wherein upper front part of this wall is identified as 24, horizontal bottom part, 25 and vertical back part, 26. An identical contiguous support wall 27-29 is shown on the left side of frame 2. On the support wall 27-29, front part is identified as 27, bottom part, 28 and back part, 29. There is hole 30 at the top of front part 24 for insertion of the near end of axle rod 325, the latter shown in FIG. 84 below, and a corresponding hole 41 at the top front 27 of support wall 27-29 for the insertion of the far end of axle rod 325, also shown in FIG. 84 below. Also in FIG. 4, two framed boxes 31 and 32 each with corresponding holes 33 and 34 in their vertical back walls are shown on the right side of bottom of frame 2. Corresponding framed boxes 35 and 36 with corresponding holes 37 and 38 in their respective vertical backwalls on the left side of the bottom of frame 2 also exist and are shown in FIG. 8. FIG. 4 illustrates two additional holes 39 and 40, former on vertical back part 26 and the latter, on part 29. FIG. 4 also illustrates jagged teeth 51 at the front bottom of frame 2 that runs parallel to the front wall of frame 2. These teeth 41 have thickness and depth that are determined by the toughness of the fabric used, that is, harder the fabric to tear, greater is the thickness and depth of teeth 51.

Figure 37:
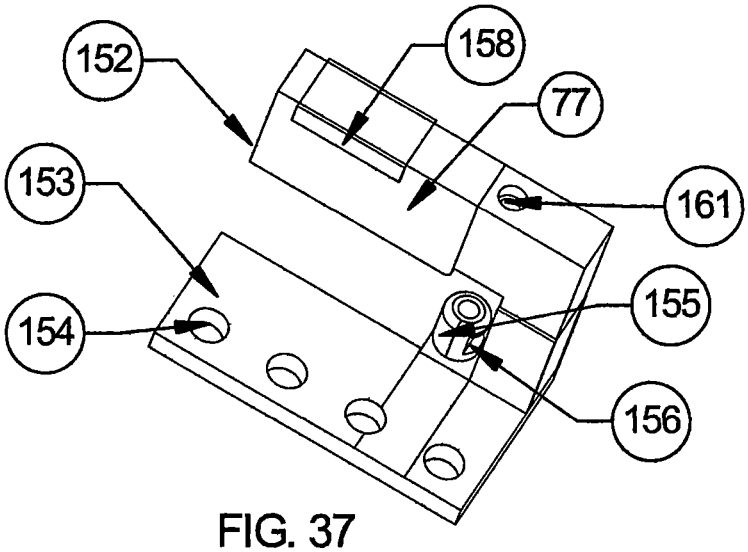
FIG. 37 is a perspective view of the left slider connector.
Figure 45:
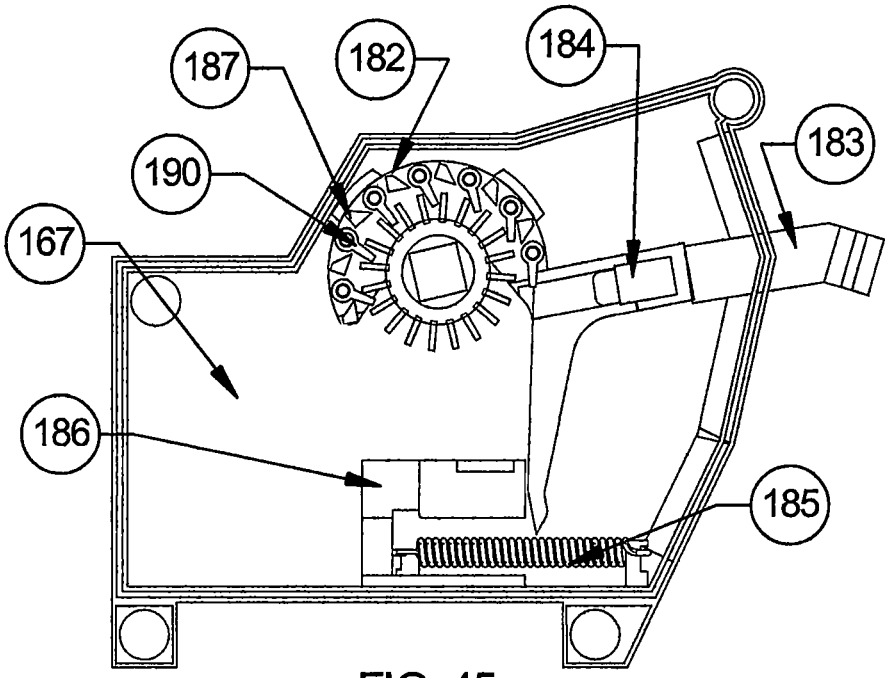
FIG. 45 is an elevation view of the right exterior wall assembly.

One large square opening 42 in the floor of Frame 2, that hollows out the otherwise solid floor except for the width of teeth 41, is also shown in FIG. 4. Two long horizontal openings or slits 43 and 44, along the length of respective bottom parts 25 and 28 are illustrated FIG. 4, wherein the former opening 43 runs along bottom part 25 on the right side of frame 2 forming a long horizontal slit, while slit 44 runs along part 28 on the left side of frame 2. The width of slit 44 is slightly larger than the thickness of bottom plate 153 of left slider connector 77 as shown in FIG. 37, and the width of slit 43 is symmetrically equal to that of slit 44, the latter for slider connector 186, which is shown in FIG. 45.

As illustrated in FIG. 4, there is flat plate extension with three contiguous parts 45-47 comprising front part 45, bottom part 46, and back part 47, all of which project out of and are perpendicular to contiguous parts 24-26 on the front right side of frame 2. There are corresponding three identical contiguous parts 48-50 on the left side of frame 2 that are not visible in FIG. 4.

Figure 5:
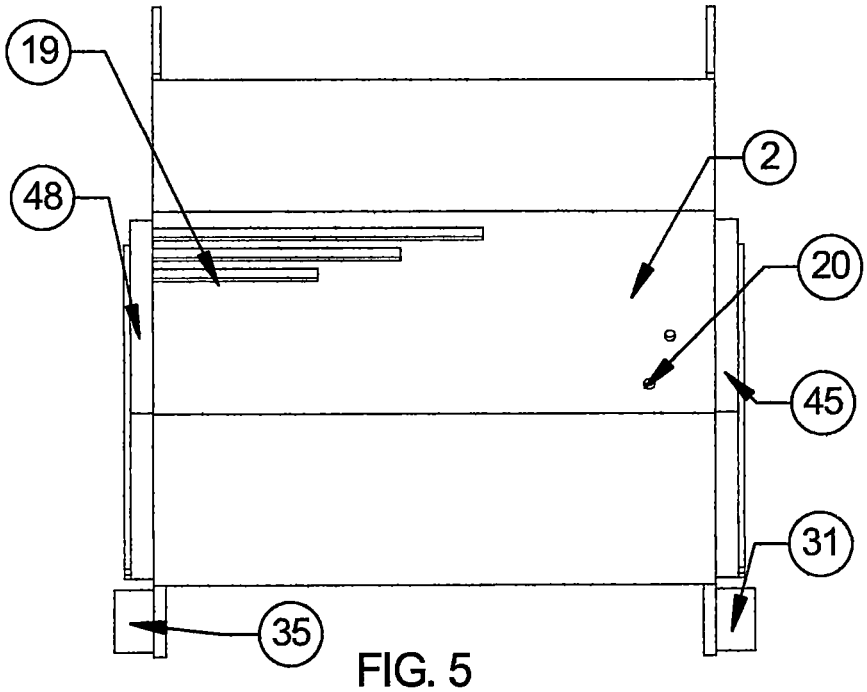
FIG. 5 is a front elevation view of the base frame.
Figure 6:
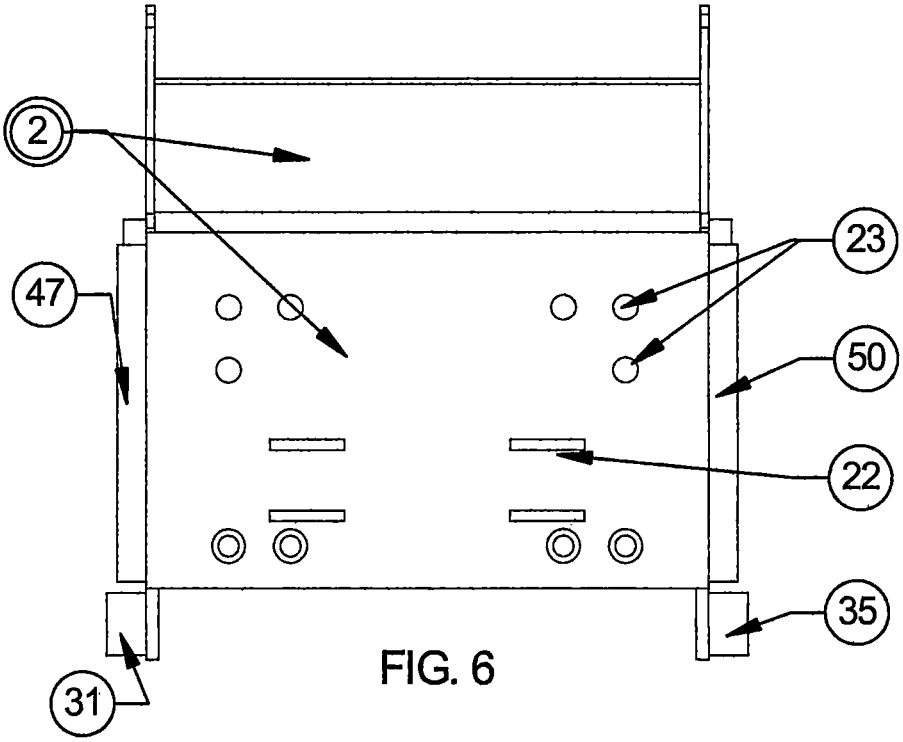
FIG. 6 is a rear elevation view of the base frame.

FIGS. 5 and 6 show front and rear elevation views of the same frame 2 for added clarity.

Figure 7:
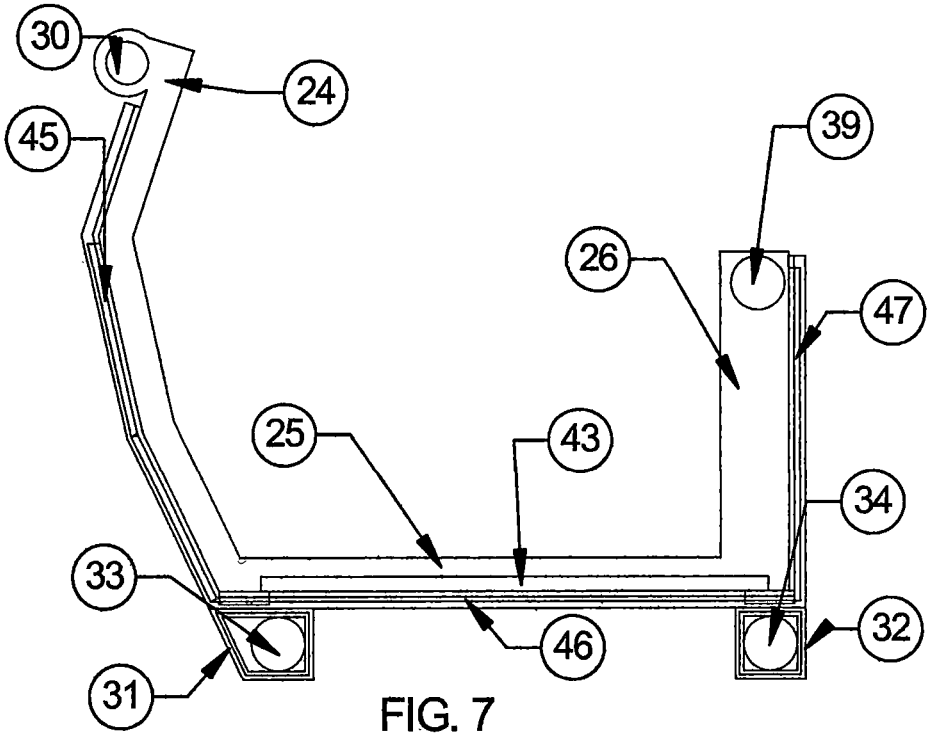
FIG. 7 is a right side elevation view of the base frame.
Figure 8:
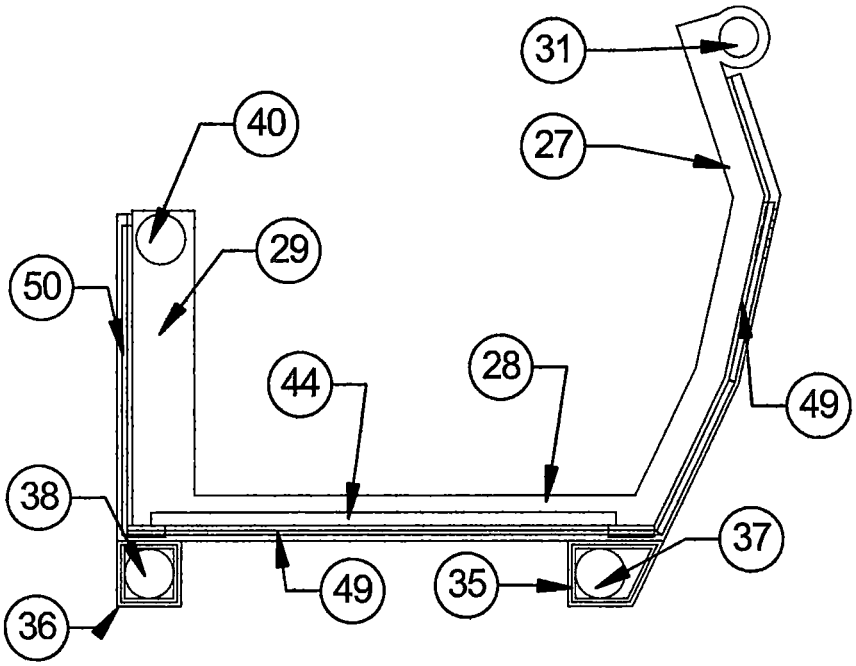
FIG. 8 is a left side elevation view of the base frame.

FIGS. 7 and 8 further illustrate clarity for frame 2 in elevation views looking to the right and left sides of frame 2 from outside of frame 2. In the right side of frame 2 view in FIG. 7, holes 30, 33, 34 and 39, and slit 43 on parts 24-27 and bottom framed boxes 31 and 32 respectively are illustrated for greater clarity. In the left side of frame 2 view in FIG. 8, holes 31, 37, 38 and 40, and slit 44 on parts 27-29 and bottom framed boxes 36 and 37 respectively are illustrated for greater clarity. Flat plates 45-47 on the right side of frame 2 and plates 48-50 as shown in FIGS. 7 and 8 are not needed if frame 2 and exterior walls 4 and 8 are built or cast as a single integrated unit.

Figure 9:
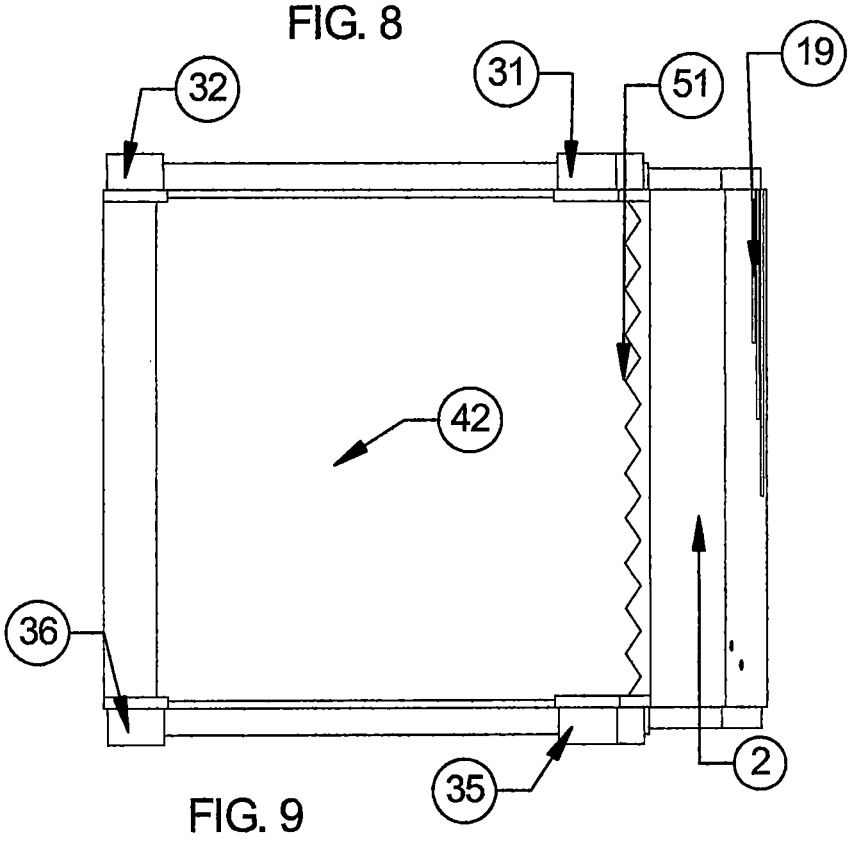
FIG. 9 is a bottom plan view of the base frame.

FIG. 9 illustrates for clarity the plan view of the bottom of frame 2 looking up. This plan view illustrates the horizontal depth of teeth 51 at the bottom of the front wall of frame 2. It also illustrates opening 42 and its expanse. On the four corners of this frame 2 bottom are located four bottom framed boxes 31, 32, 35 and 36.

Figure 10:
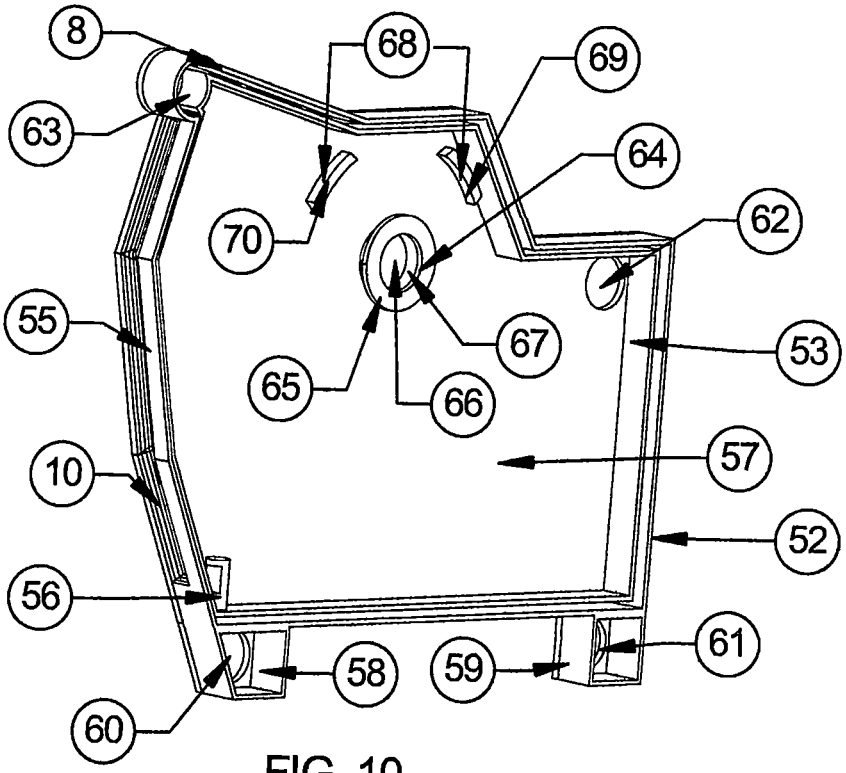
FIG. 10 is a perspective view from inside of the left exterior wall.
Figure 11:
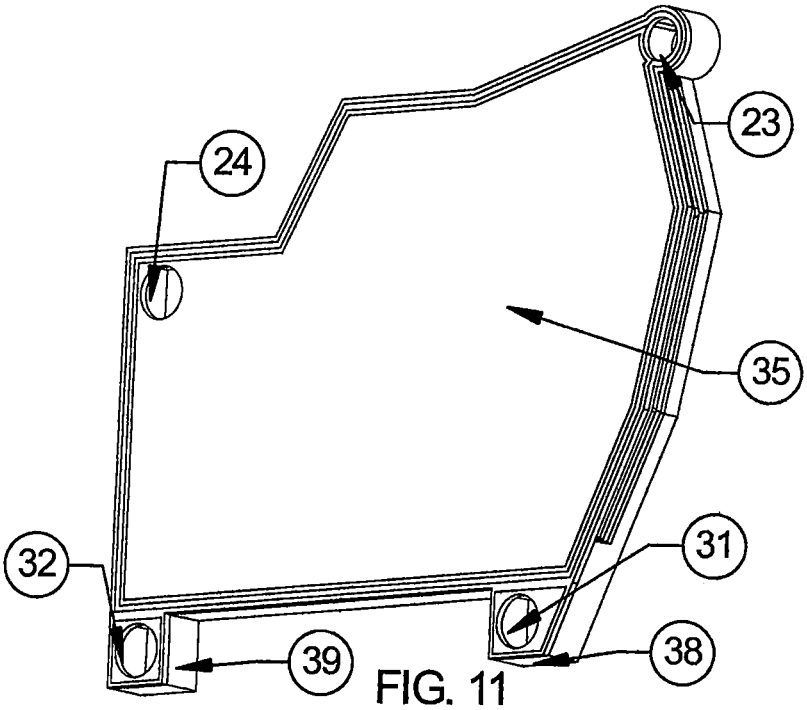
FIG. 11 is a perspective view from outside of the left exterior wall.
Figure 12:
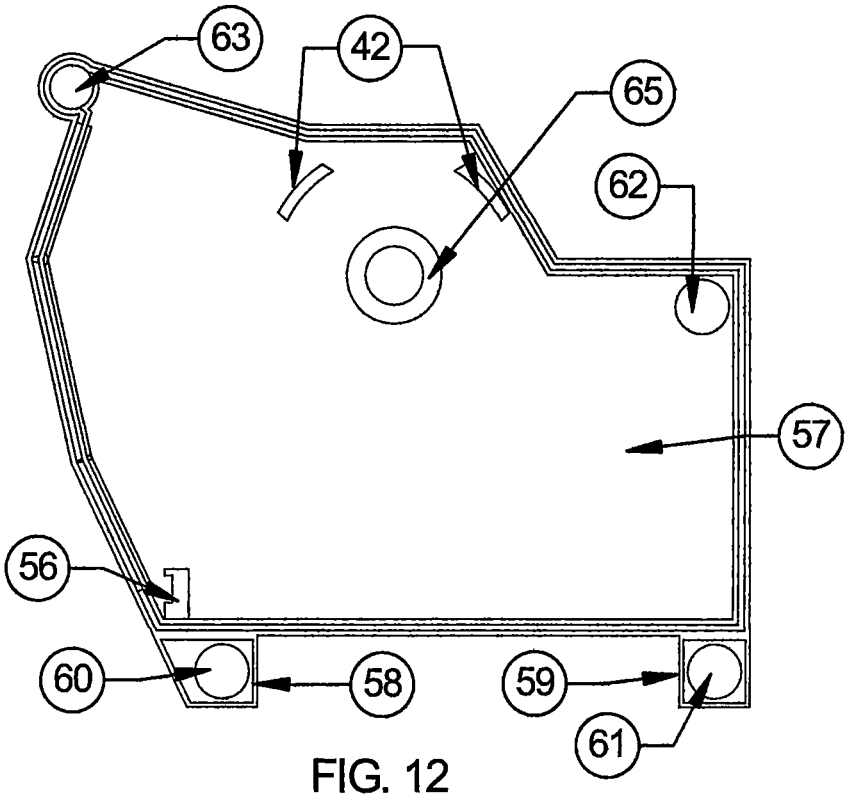
FIG. 12 is an elevation view from outside of the left exterior wall.
Figure 13:
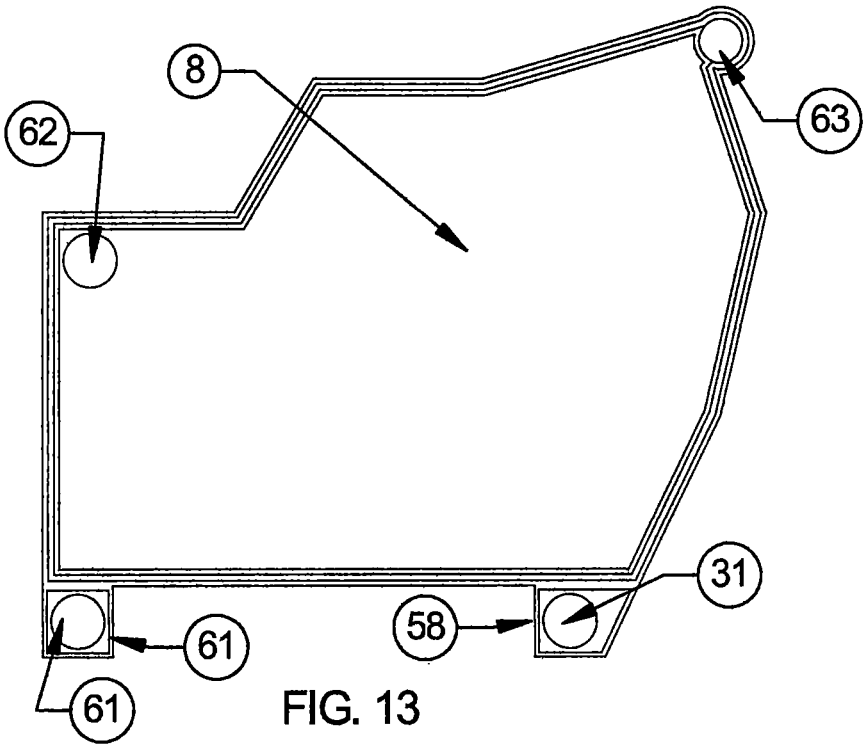
FIG. 13 is an elevation view from inside of the left exterior wall.
Figure 14:
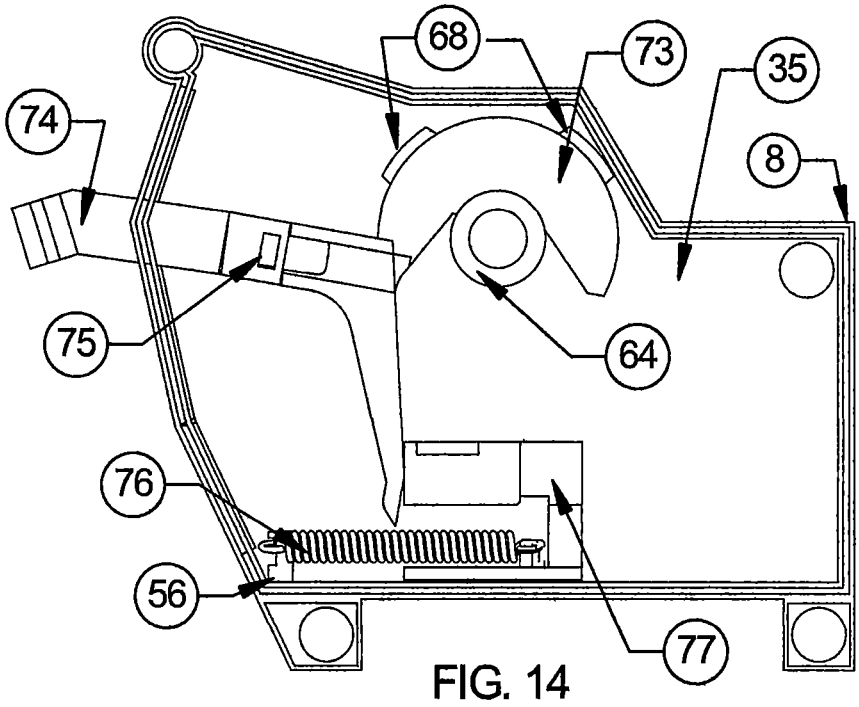
FIG. 14 is an elevation view of the assembly of parts on the left exterior wall.
Figure 15:
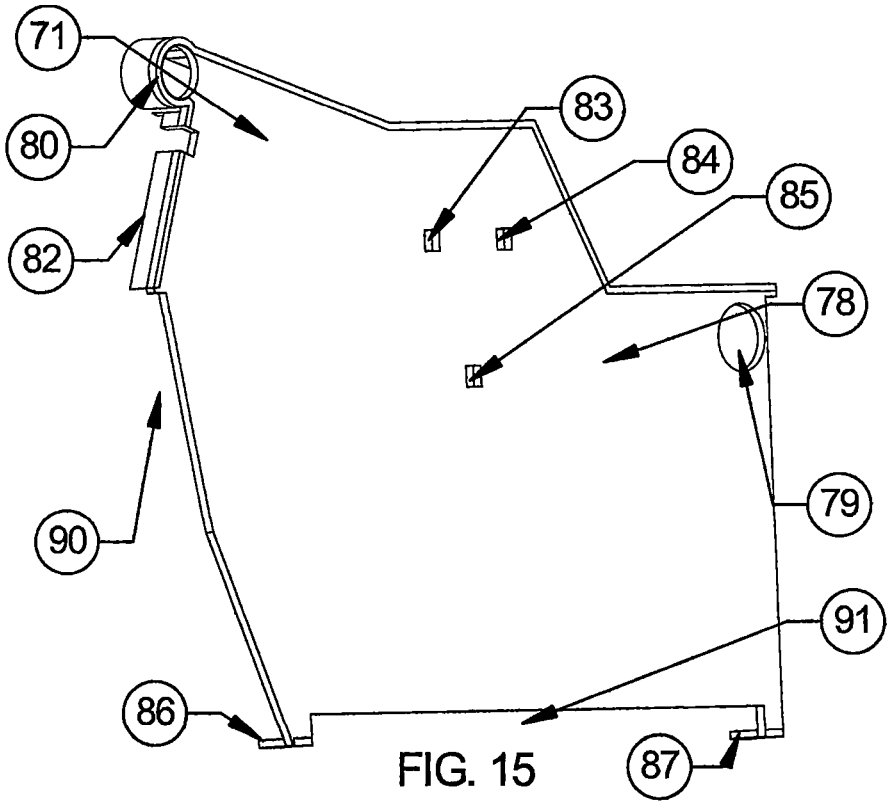
FIG. 15 is an elevation view of the left interior wall looking from inside of the dispenser.
Figure 16:
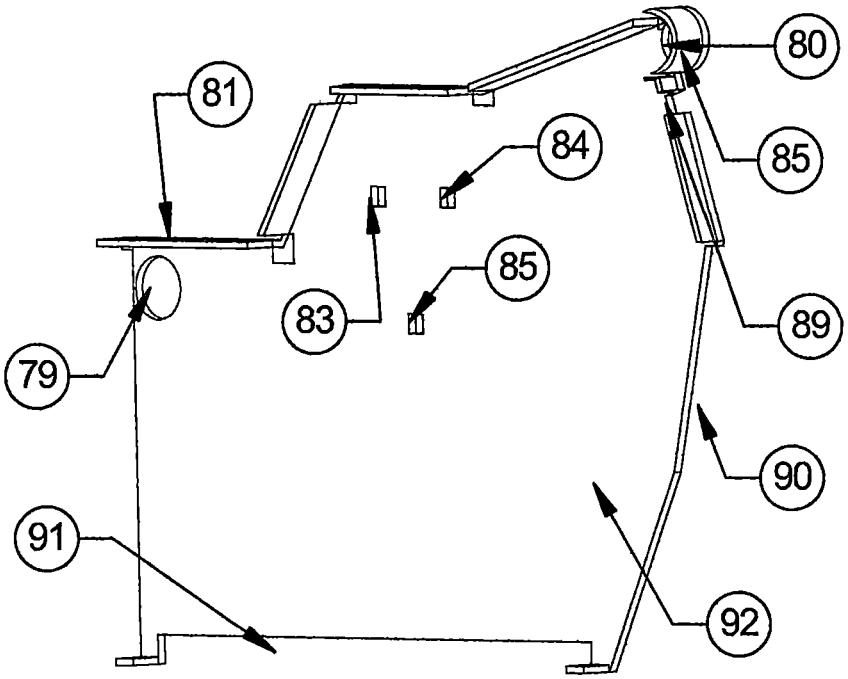
FIG. 16 is a perspective view of the left interior wall looking from outside the dispenser.

3. Left Exterior Wall: FIGS. 10-13 show the details of left exterior wall 8, in which FIGS. 10 and 11 illustrate a perspective view of interior and exterior details of wall 8 and FIGS. 12 and 13 illustrate corresponding elevation views. There is a contiguous outer parapet wall 52 that runs all around wall 8 and is perpendicular to the inner face 57 of wall 8 such that the outer face of parapet wall 52 is in the same plane as the outer edge of face 57. Parallel to outer parapet wall 52, runs an inner parapet wall 53 creating a channel 54 all around face 57. The height of outer wall 52 is more than that of inner wall 53 by an amount equal to the thickness of the left interior wall 71, the latter as illustrated in FIGS. 15 and 16. Height of wall 53 is designed to ensure that the interior of left exterior wall 8, between the inner face 57 of left exterior wall 8 and inner face 92 of left interior wall 71 contains and allows free movement of the interior parts shown in FIG. 14 as described in section 4 here below.

The width of channel 54 is designed such that the plates 48-50 of frame 2 fit tightly into it all around. FIGS. 10 and 11 further illustrate opening 55 that runs through the front side of both outer and inner parapet walls 52 and 53 from top to bottom. This opening 55 is designed to provide for the free movement of left lever handle extension 74 which is shown in FIG. 14 and described in paragraph 4 here below. The flat plate extensions 48-50 of frame 2 are inserted into channel 54 all the way to inner face 57 to mount the exterior wall 8 onto frame 2, however, its front part, that is, flat plate extension 48 at the front of frame 2 has a reduced height so as not project into the opening 55 but rise up to the inner face 57 side of opening 55 thereby avoiding any obstruction to the free movement of lever handle extension 74 as shown later in FIG. 14.

FIG. 10 shows spring holder stub 56 at the front bottom of wall 8. Stub 56 sits vertically on the front end of the horizontal run of inner wall 53. FIGS. 10 and 11 illustrate two bottom socket boxes 58 and 59 with their vertical outside walls having holes 60 and 61 respectively. FIGS. 10 and 11 also show hole 62 at the top back of inner face 57 and hole 63 at the top front also of face 57 with parallel parapet walls 52 and 53 running around hole 63. FIG. 10 further shows round axial central guide 64 with an internal radius 66 that allows smooth rotary movement of left lever 73 over the round wall 67, this wall 67 being slightly higher than the thickness of lever 73 and having a circular hat 65 designed to prevent slipping of lever 73 away from the plane of inner face 57. Two short and partially round circumferential guides 68, one being the mirror image of the other, are also shown situated on inner face 57 and centrally located at distance from guide 64 in FIG. 10. The roundness of guides 68 is parallel to the roundness of central guide 64 and their inner circumference matches that of the lever 73 roundness as shown in FIG. 14. Height 69 of guides 68 above face 57 is the same as height 67 of guide 64, and width 70 is sized such that the right part of guides 68 does not touch slanted part of inner wall 53.

Going further, FIG. 11 shows the perspective view of left exterior wall 8 looking from outside of dispenser 1, and FIG. 12 shows the same in elevation view for added clarity. Similarly, FIG. 13 is the elevation view of the perspective view shown in FIG. 10 for added clarity.

4. Left Exterior Wall Assembly: FIG. 14 illustrates left exterior wall 8 assembly including associated subsystems on the inside of the wall comprising left lever 73, attached to left lever extension 74, wherein the former is connected to the latter with a locking key 75, extension spring 76, and slider connector 77, wherein slider connector 77 is connected to stub 56 via extension spring 76.

5. Left Interior Wall: FIGS. 15-16 illustrate the perspective views of left interior wall 71 wherein FIG. 15 comprises a view looking from outside of dispenser 1 and FIG. 16, from inside of frame 2. FIGS. 15 and 16 further illustrate hole 79 at the top corner for inserting nut-screw pair 16 as shown in FIG. 2, circular hole 80 at the top front for inserting nut 15, top parapet wall 81 running along the top edge of wall 71, and slanted parapet wall 82. Other features shown in these two figures are as follows. There are three square holes 83-85 on the upper central part of wall 49. These holes 83-85, which may be designed in different configurations and sizes for different sizes of the dispenser system 1, support mounting of bracket 89 using their square back pins 126-128, this bracket 89 being illustrated in detail later in FIGS. 28-36 and described in paragraph 8 below.

Two short parapet walls 86 and 87 are shown at the bottom front and back ends of wall 71 in FIGS. 15 and 16. Parapet walls 81, 82, 86 and 87 are meant to mount wall 71 into channel 54 of left exterior wall 8. Slanted wall 82 is designed with a shorter height, not unlike left side front plate extensions 45 of frame 2, to allow free movement of left lever extension 74. There is a short notch or cut 89 in parapet wall 82, towards its top end, which is meant for inserting the flat tip of a screwdriver or similar implement to aid in lifting inner wall 71 from channel 54 and thus separating left interior wall 49 from the attached left exterior wall 8. There is a bottom horizontal opening 91 in wall 71 that runs from the inner edge of parapet wall 86 to the inner edge of parapet wall 87 to aid in the free movement of slider connector 77 detailed later in FIGS. 37-42. Finally, all parapet walls 81, 82, 86 and 87 project out of the inner face 9 and perpendicular to it, toward the inner face 57 of exterior wall 8.

Figure 18:
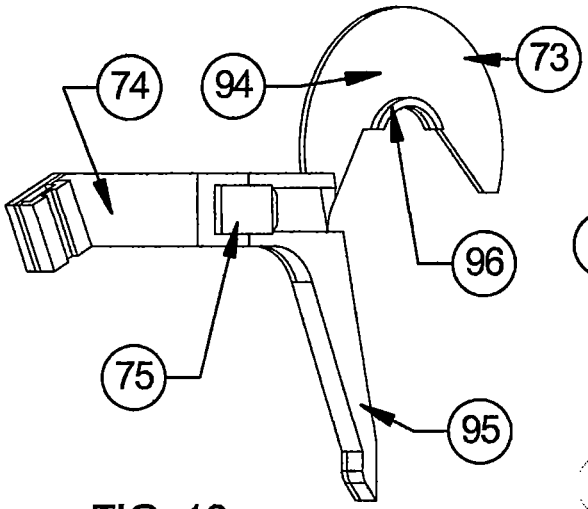
FIG. 18 is a perspective view of the left lever assembly.
Figure 19:
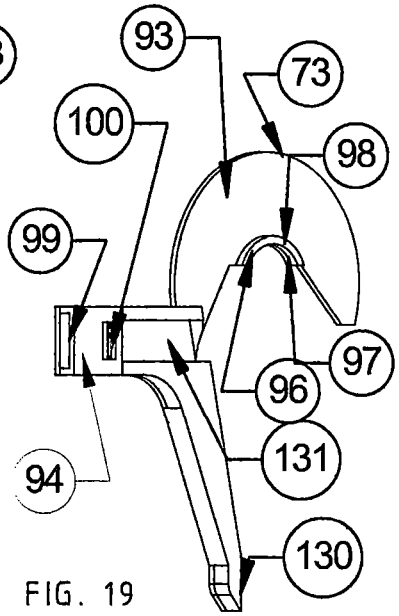
FIG. 19 is a perspective view of only the left lever.

6. Left Lever System Assembly: FIGS. 18-27 illustrate left lever system assembly including all its parts. FIG. 18 comprises left lever 73 comprising flat rounded head end 93, horizontal arm 94 and narrowing long leg 95, left lever extension 74, and square locking key 75. The main part of lever 73 assembly is left lever 73 which is further illustrated detail in FIG. 19. FIG. 19 shows left lever flat round head 93 with external round edge and inner round partially circular guide 96 which has a raised, partially circular, edge wall 97 of height 98, wherein height 98 is designed such that wall 97 fits under hat 65 of axle 64, the latter as shown in FIG. 10, and the radius of guide 96 and therefore its edge wall 97 is same as that of round central guide 64. Lever 73 has left arm 94 that extends below the left end of head 93 and leg 95, the latter extends below the lower front edge of left arm 94. A part of arm 94 has rectangular covered channel 99 at its far end with rectangular window 100 on its top cover. The remaining part of arm 94 has no cover but has open channel 101 extending till the right vertical face 102 of leg 95. Window 100 is designed for inserting locking key 75 which locks the lever arm 94, thereby lever 73, with lever extension 74. Vertical face 102 engages with the vertical face of the left slider connector 77 as shown in FIG. 14.

Figure 20:
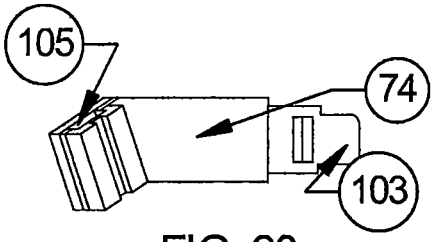
FIG. 20 is a perspective view of the left lever extension.
Figure 21:
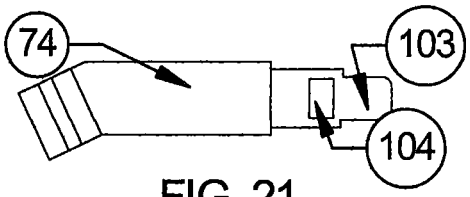
FIG. 21 is a front elevation view of the left lever extension.
Figure 22:
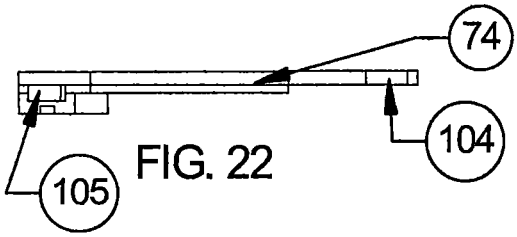
FIG. 22 is a plan view of the lever extension.
Figure 23:
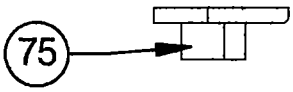
FIG. 23 is a perspective view of the lever locking key.
Figure 24:
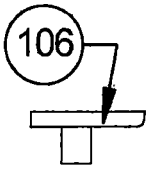
FIG. 24 is an elevation view of the lever locking key.
Figure 25:
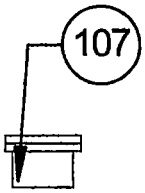
FIG. 25 is an elevation view of the lever locking key.
Figure 26:
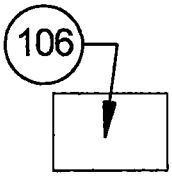
FIG. 26 is a plan view from top of the lever locking key.
Figure 27:
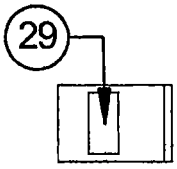
FIG. 27 is a plan view from below of the lever locking key.
Figure 59:
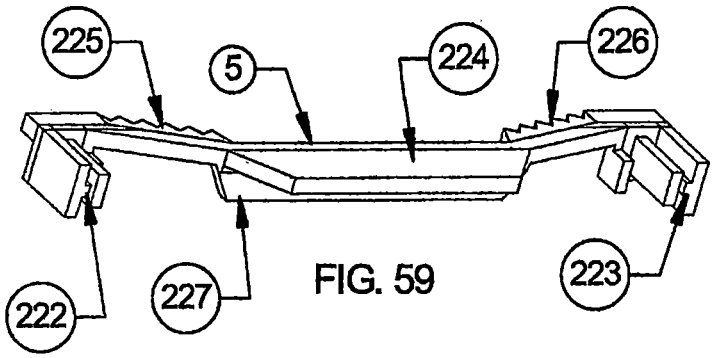
FIG. 59 is a perspective view of the frame front handle.

Left lever extension 74 is detailed in FIGS. 20-22 that include its perspective view in FIG. 21 and its front and side elevation views in FIGS. 21 and 22 respectively. The extension 74 has at its left end grooved stub 105 bent downward in that stub 105 has multiple rectangular channel cuts designed to tightly mount the left end 222 of the front handle 5, the latter is shown in FIG. 59. Several views of the grooved stub 105 are also illustrated in plan and elevation views in FIGS. 20-22 for added clarity. The lever extension 74 also has front lip 103 and a rectangular opening 104 all through its thickness such that when extension 74 is inserted into lever arm 94 all the way as shown in FIG. 18, lip 103 tightly fits on its two sides of open channel 101 and rectangular opening 104 aligns with window 100.

Key 75, illustrated in FIGS. 23-27, has rectangular flat horizontal top 106 and short leg 107, the latter being also rectangular in cross-section. When extension 74 is inserted into lever arm 94 all the way, as shown in FIG. 18, and leg 107 of key 75 is inserted through window 100 and opening 104, the two parts, lever 73 and extension 74, lock up such that the lever extension 74 acts as an integrated and extended arm of lever 73. The reason for having a separate part, extension 74, is that lever 73 with a longer arm with its length equal to the combined length of arm 94 with extension 73 would not allow mounting of the lever assembly within parapet wall 53 inside of left exterior wall 8. Additionally, insertion of the external rounded head end 93 around central guide 64 also requires careful sizing and placement of the circumferential guide 42, such placement requiring splitting outer guide into two identical halves, guides 68, as shown in FIG. 10. Additionally, this reduces dispenser 1 weight thereby saving material and build time. The size of window 100, opening 104 and key leg 109 can be of a shape different from rectangle so long as they correspond with each other for a good fitting, their size being driven by the size of dispenser 1.

Figure 28:
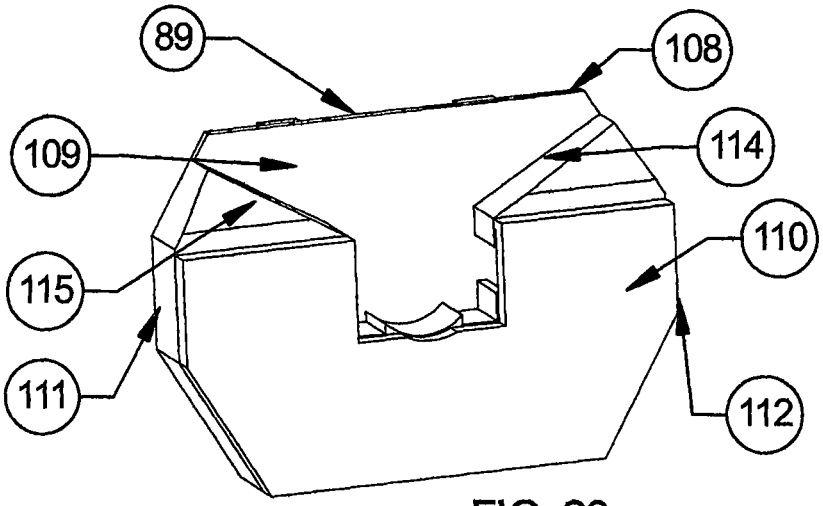
FIG. 28 is a perspective view of the fabric roll shaft holder bracket assembly.
Figure 29:
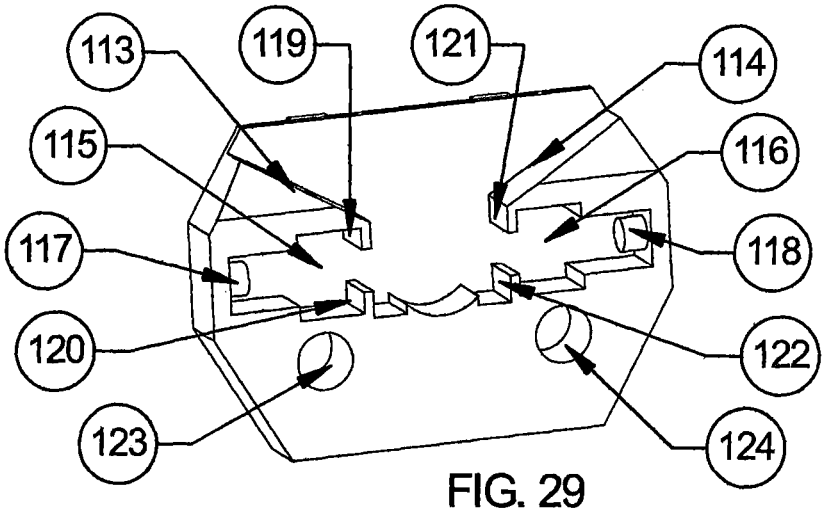
FIG. 29 is a front perspective view of the fabric roll shaft holder bracket base.

7. Left Wall Mounted Roll Shaft Holder Bracket Assembly: FIG. 28 illustrates left wall mounted fabric roll shaft holder bracket assembly 89 which is used for mounting fabric holder shaft 238, the latter first depicted in FIG. 69. Bracket assembly 89 comprises two parts, first, bracket base 108, shown in FIGS. 28-30, and second, bracket cover 110, shown in FIGS. 31 and 32. Bracket base 108 has flat face 109, which is thin in the upper half and thick in the lower half, the latter having two rectangular wings on two sides, on the left and right, named here as two wide side walls 111 and 112. Side walls 111 and 112 have slanted or sloped cuts 113 and 114 respectively, wherein these cuts slope down toward the middle of base 108. Two identical rectangular cavities 115 and 116, in walls 111 and 112, that have smaller cross-section halfway toward the back of each cavity, are shown in FIG. 29. On the back walls of these rectangular cavities 115 and 116, are two short identical horizontal round pins 117 and 118 respectively. Cavities 115 and 116 additionally have identical top and bottom short overhang walls 119 and 120 at their open end on the left side and 121 and 122 on the right side.

Figure 30:
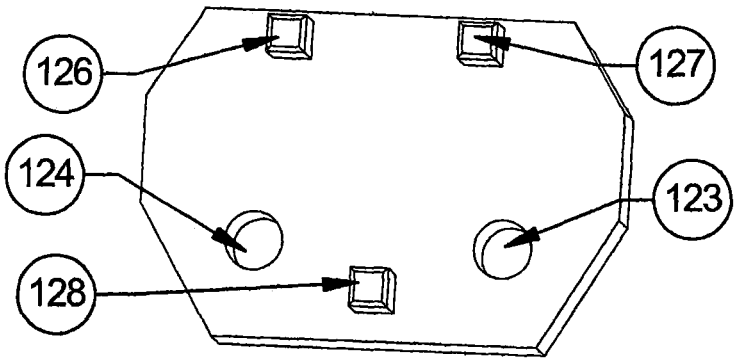
FIG. 30 is a perspective view of the front of the fabric roll shaft holder bracket cover.

FIG. 29 also shows two equal sized holes 123 and 124 that are identically located below the cavities 115 and 116 respectively to allow mounting of bracket cover 110. FIG. 29 also illustrates curved floor 125 in the middle part of base 108 and between cavities 115 and 116 which is at the bottom of rectangular space in between lower overhang walls 120 and 122. Curved floor 125 is used for resting round end 291 of the fabric holder shaft 238 depicted in FIGS. 69 and 70. FIG. 30 shows three equal sized square pins 126-128, with their cross-section size slightly smaller than that of holes 83-85 on back of the left interior wall 71, the latter as shown in FIG. 15. These pins 126-128 project out of the back of bracket 89 base 108. These square pins are used to mount bracket assembly 89 on to back of the left interior wall 71 by inserting them into holes 83-85, the latter shown in FIG. 15, while the mounted views are provided in FIGS. 17 and 84.

Figure 31:
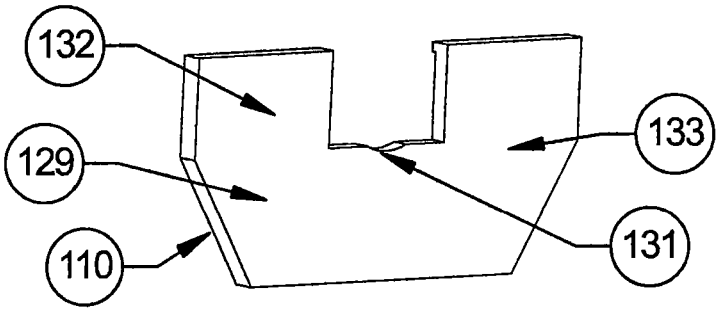
FIG. 31 is a perspective view of the back of the fabric roll shaft holder bracket cover.
Figure 32:
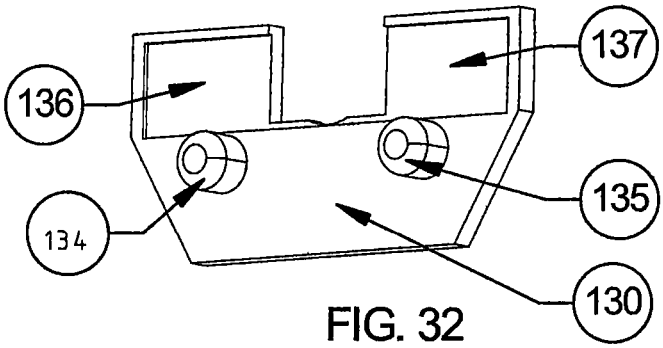
FIG. 32 is a rear perspective view of the axle holder bracket assembly cover.
Figure 33:
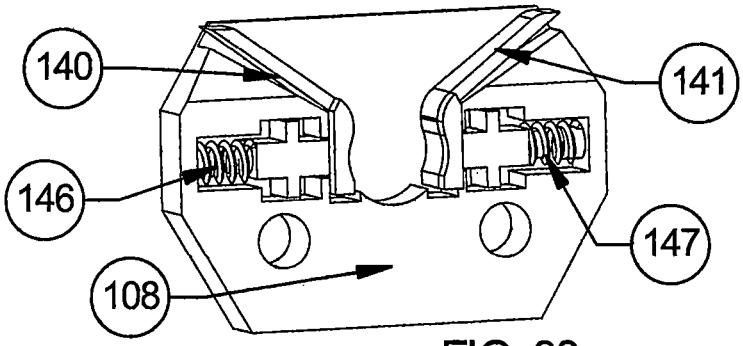
FIG. 33 is a perspective view of the fabric roll shaft holder bracket assembly base.

FIGS. 31 and 32 illustrate details of thin bracket cover 110 that is shaped to match the lower side of bracket 89. There are two square wings 132 and 133 on two sides of cover 110, looking toward its front face 129, that match the size and shape wide side walls 111 and 112 of bracket 89 as shown in its assembled view in FIG. 28. FIG. 31 shows curved floor 131 that matches in curvature of curved floor 125 and aligns with it when cover 110 is mounted on bracket base 89, again as shown in FIG. 28. There are two rectangular inner cutouts 135 and 136 on two sides of back face 130 of cover 110 which provide stoppers 140 and 141 to move freely underneath cover 110, their assembled view without the cover 110 is shown in FIG. 33. FIG. 32 shows two equal sized short round pins 134 and 135 with tapered ends that match in their diameter to holes 123 and 124 and are located to align with the holes such that cover 110 tightly mounts onto bracket base 108 forming bracket assembly 89 as a single integrated part. This also makes curved floors 125 and 131 align such that both become concentric with the axis of the round end 238 of shaft 238.

Figures 34, 35:
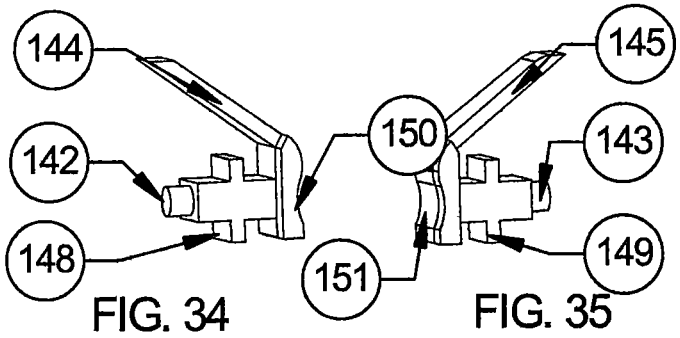
FIG. 34 is a perspective view of the left stopper.
FIG. 35 is a perspective view of the right stopper.
Figure 36:
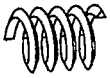
FIG. 36 is a perspective view of the compression spring.
Figure 85:
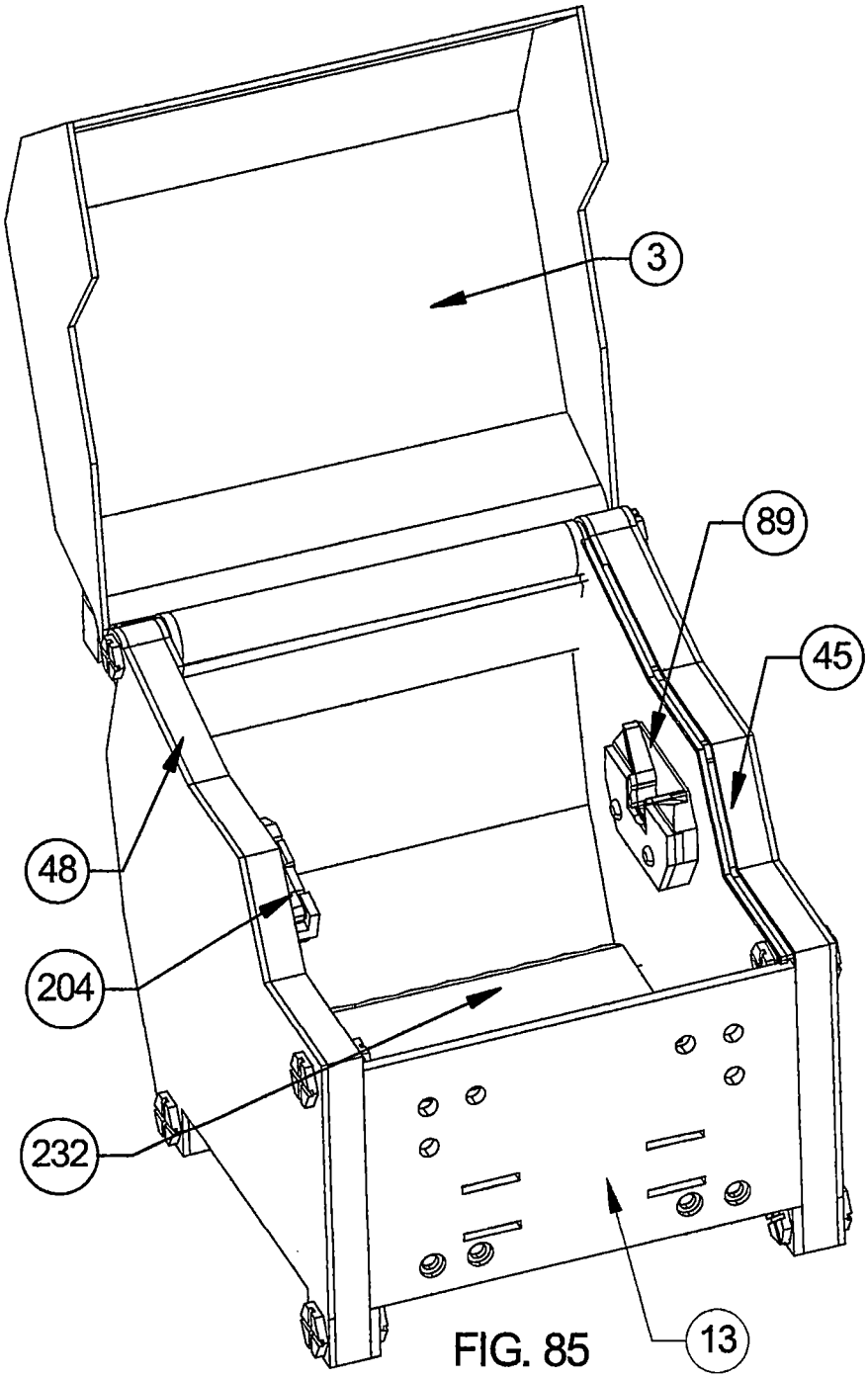
FIG. 85 is a perspective view of the dispenser with fabric roll shaft holder bracket.

FIG. 33 shows the details of the two specially configured stoppers 140 and 141, also illustrated individually in FIGS. 34 and 35, one being a mirror image of the other, that are placed inside cavities 115 and 116 in a way that their round pin ends 142 and 143 are concentric with pins 117 and 118 of bracket 89 respectively and their sloped wings 239 and 240 sit on the slope cuts 113 and 114 of base 108. FIG. 33 further illustrates two identical compression springs 146 and 147. A view of these springs is shown in FIG. 36 for greater clarity. Springs 146 and 147 are concentrically mounted on pins 117 and 142 on the left side, and on pins 118 and 143 on the right side. The vertical intermediate walls 148 and 149 of stoppers 140 and 141 butt against overhang walls 119 and 120 on the left side and against overhang walls 121 and 122 on the right side as the attached corresponding springs 146 and 147 push them out toward the center of the bracket 89 and thereby prevent the stoppers from going out of respective cavities 115 and 116. Sloped walls 239 and 240 of respective stoppers 140 and 141 are meant for easy insertion of round end 291 fabric holder shaft 238 down to combined curved floors 125 and 131 of bracket assembly 89. Vertical outer curved walls 150 and 151 of respective stoppers 140 and 141 have a curvature that match the curvature of round end 291 for smooth rotary movement of the fabric holder shaft 238. Springs 146 and 147 are selected with a compression strength such that they allow curved walls 150 and 151 at their respective ends to have a firm grip of round end 291 allowing shaft 238 to rotate smoothly and without any slippage. FIG. 85 illustrates this bracket mounted on left interior wall 71.

8. Left Slider Connector: FIGS. 37-42 illustrate various views of the left slider connector 77. FIG. 37 provides its perspective view while FIGS. 38-42 illustrate related elevation and plan views. There are two slider connectors installed in dispenser assembly 1, one on the left, slider connector 77, and the other on the right, slider connector 186, described below for the illustration in FIG. 45. These two slider connectors 77 and 186 connect to the mid-slider connector 232, the latter first illustrated in FIG. 63, and their combined view in FIG. 67.

Figure 38:
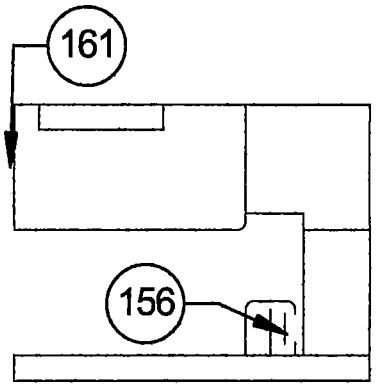
FIG. 38 is a side elevation view of the left slider connector.

Left slider connector 77 comprises armrest construct 152 which further comprises a horizontal arm connected to a vertical leg on one of its end, both rectangular in cross-section, wherein the vertical leg is connected to bottom plate 153 having multiple holes 154, bottom plate 153 further having stub 155 at one of the plate with a notch 156 on its inner side toward the vertical leg, small wrapper plates 157 and 158 on the two vertical faces of the free end of the horizontal arm and large wrapper plates 159 and 160 on the two vertical faces of the bottom of the vertical leg. In normal condition, front vertical face 161 of the free end of horizontal arm of connector 77 buts against the flat vertical edge 102 of the leg 95 of the left lever 73 as illustrated in FIG. 14. The number of holes 154 is dependent on the size of dispenser 1. FIG. 38 shows an elevation view of notch 156 on stub 155, which is meant to hold the front-end hook of extension spring 76 as illustrated in FIG. 14.

Figure 17:
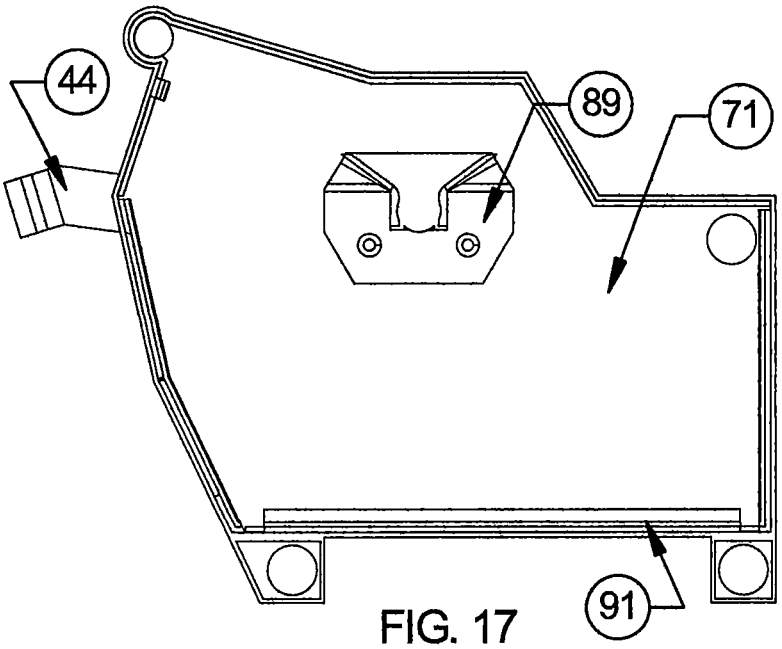
FIG. 17 is an elevation view of the left interior wall looking from inside of the dispenser.
Figure 39:
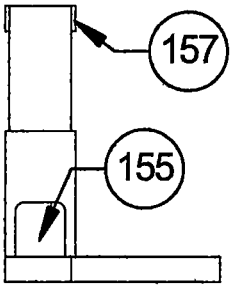
FIG. 39 is a front elevation view of the left slider connector.
Figure 40:
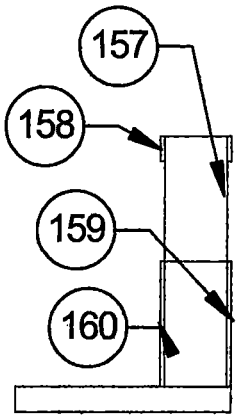
FIG. 40 is a rear elevation view of the left slider connector.
Figure 41:
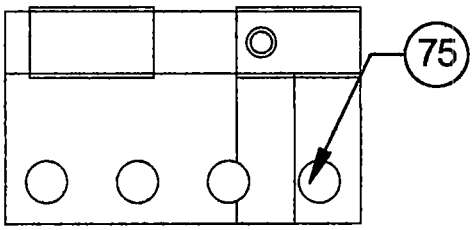
FIG. 41 is a top view of the left slider connector.
Figure 42:
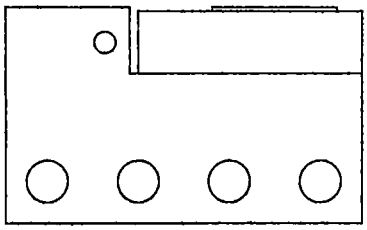
FIG. 42 is a bottom view of the of the left slider connector.

Wrapper plates 157 and 159 provide separation between the outer face or side of slider connector 77 and inner face 57 of left exterior wall 8, the latter as shown FIG. 10, while wrapper plates 158 and 160 provide separation between inner side of connector 77 and inner face 92 left interior wall 71 on the inside side, latter as identified in FIG. 16, respectively. These separations are minimal and designed such that they provide for smooth movement of connector 77 within the inner faces of walls 8 and 71. Bottom plate 153, that contains multiple holes 75, horizontally extends away from the vertical leg of construct 77 as shown in FIGS. 39 and 40. This extension allows the bottom plate 153 to protrude out through the bottom long opening 91 of left interior wall 71 as well as through matching opening 44 of frame 2 as shown in FIG. 17. The vertical widths of openings 91 and 44 are slightly greater than the thickness of plate 153 thereby allowing connector 73 to move freely, in both directions, that is, from front to back and back to front of the dispenser 1.

Figure 43:
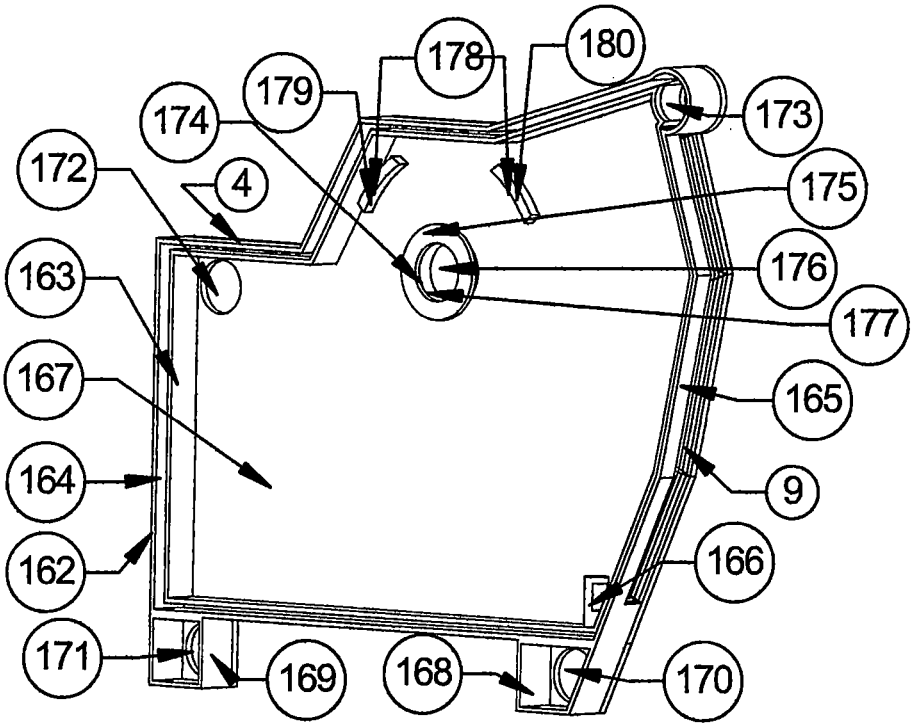
FIG. 43 is a perspective view from inside of the right exterior wall.
Figure 44:
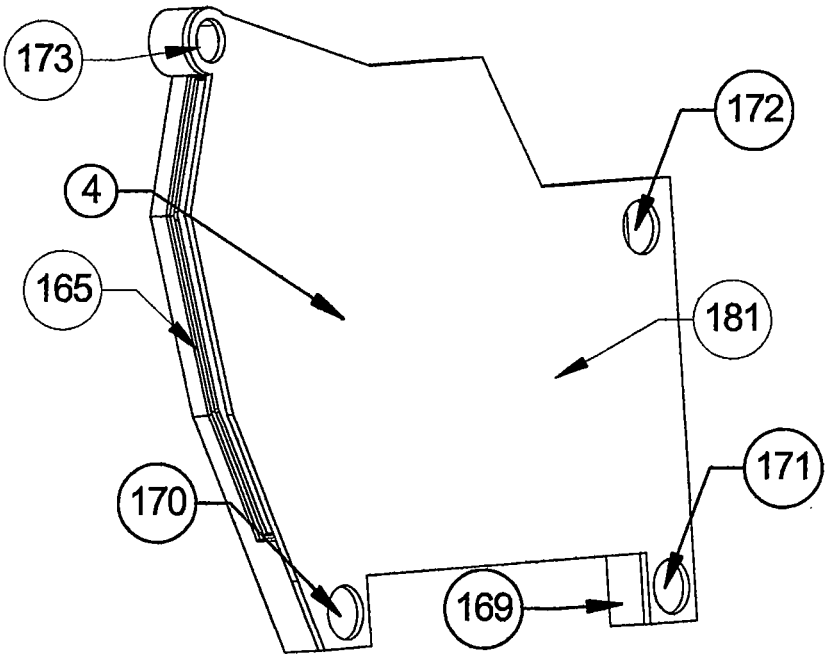
FIG. 44 is a perspective view from outside of the right exterior wall.

9. Right Exterior Wall: FIGS. 43 and 44 illustrate the right exterior wall 4 which is an exact mirror image of left exterior wall 8, as illustrated in. FIGS. 43 and 44 further show holes 170, 171, 172 and 173 that are concentrically aligned with holes 60, 61, 62 and 63 of wall 4, the latter holes as shown in FIG. 10. Stub 166 and guides 178, shown in FIG. 43, are also identical mirror images of the corresponding parts of wall 8 shown in FIG. 10. Other parts such as the outer and inner parapet walls 162 and 163 with the channel 164 are also mirror images of their counter parts in left exterior wall 8. Bottom socket boxes 168 and 169 are also identical in shape and size and form mirror images of their corresponding parts in wall 8. Central guide 174 including all its various subparts 175-177 is also a mirror image of guide 64 including subparts 65-67 that are described in detail along with illustration in FIG. 10. Outer guides 178 with their features 179-180 are mirror images of guides 68 including their features 69-70. Finally, outer face 181 similarly mirrors face 72 of wall 8.

10. Right Wall Assembly: FIG. 45 illustrates right wall 4 assembly. Inside the interior of right wall 4 are the following parts: right lever 182 that has identical circumferential and central rounded edges like its counterpart left lever 73 earlier shown in FIGS. 14 and 18. The right lever extension 183, also shown in FIG. 45, is a mirror image of the left lever extension 74, shown in FIG. 18, the latter detailed in FIGS. 20-22. Locking key 184, shown in FIG. 18, is identical to key 75 detailed in FIGS. 23-26. Right slider connector 186, as illustrated in FIG. 45, is a mirror image of and identical to the corresponding left slider connector 77 illustrated in FIG. 14. The right slider connector 186 is mounted using compression spring 185, as illustrated in FIG. 45, the spring 185 being identical to spring 76, the latter as illustrated in FIG. 14. Where the difference between the left and right wall assemblies exists is between right lever's driver features and their functionalities. This is described in the following paragraphs.

Figure 46:
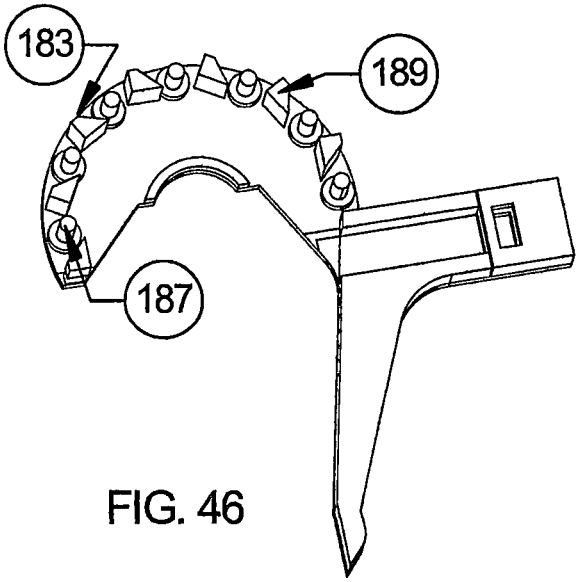
FIG. 46 is a perspective view of the right lever.
Figure 47:
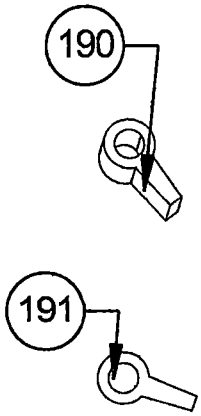
FIG. 47 are perspective and side elevation views of the driver pin.
Figure 48:
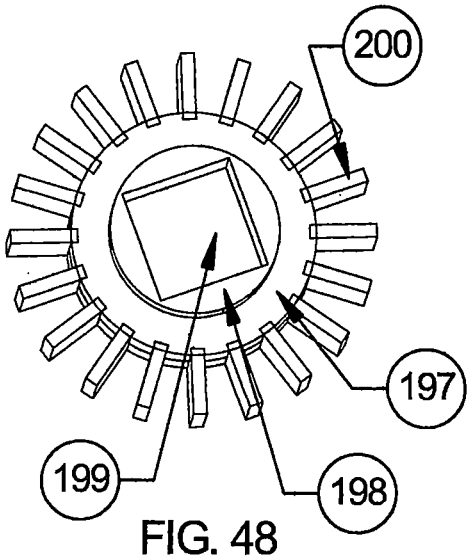
FIG. 48 is a perspective view of the front of the sprocket.
Figure 49:
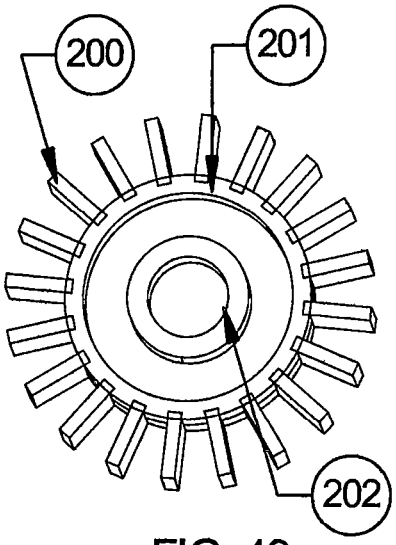
FIG. 49. is a perspective view of the back of the sprocket.
Figure 50:
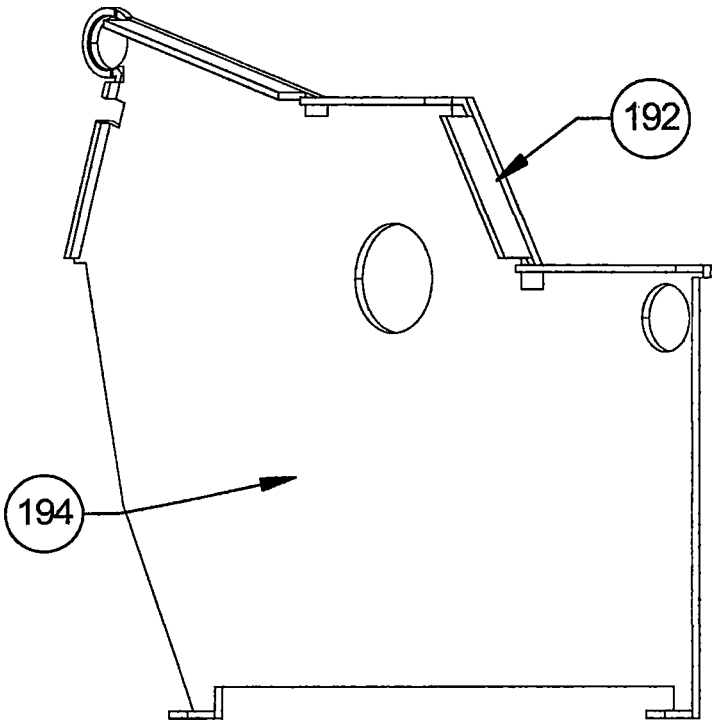
FIG. 50 is a perspective view of the right interior wall.

11. Right Lever Assembly: FIGS. 46-50 illustrate the right lever 182 driving mechanism details. FIG. 46 shows right lever 182 comprising one or more fixed pins 187 that protrude from the face of the lever and are circumferentially located around the outer round edge. Each of these fixed pins 187, has a short round base 188. The count of fixed pins 187 depends on the size of right lever 182 which itself is derived from the size of dispenser 1. FIG. 46 further shows pin stops 189 each of which is triangular in cross-section with one of the three corners being pointed close to and on the left of each of fixed pins 187. From each of fixed pins 187, hangs each of driver pins 190, the latter as detailed in FIG. 47, while their combined view is illustrated in FIG. 45. Each of these multiple driver pins 190 has clear hole 191, at one end, whose diameter is slightly larger than the fixed pin 187 such that driver pins 190 are free to rotate about the axis of fixed pins 187. Actuated by gravity and when unencumbered by any extraneous object, driver pins 190 hang vertically down. The count of pin stops 189 is same as that of fixed pins 187 as each pin stop is paired with each fixed pin. The total height of driver pins 190, round bases 188 and the thickness of the right lever 182 is designed to be less than the separating distance between the inner face 167 of the right exterior wall 4 and the inner face 194 of the right interior wall 192 as shown in FIG. 50. This combination of lever 182, driver pins 190 and the pin stops 189 acts as a driver gear train in which one or more driver pins 189 act as driver gear teeth that move a spur gear or sprocket 111 shown in FIGS. 48 and 49 only in the forward direction toward the front of the dispenser 1, that is, the driver gear is a unidirectional gear system.

Figure 51:
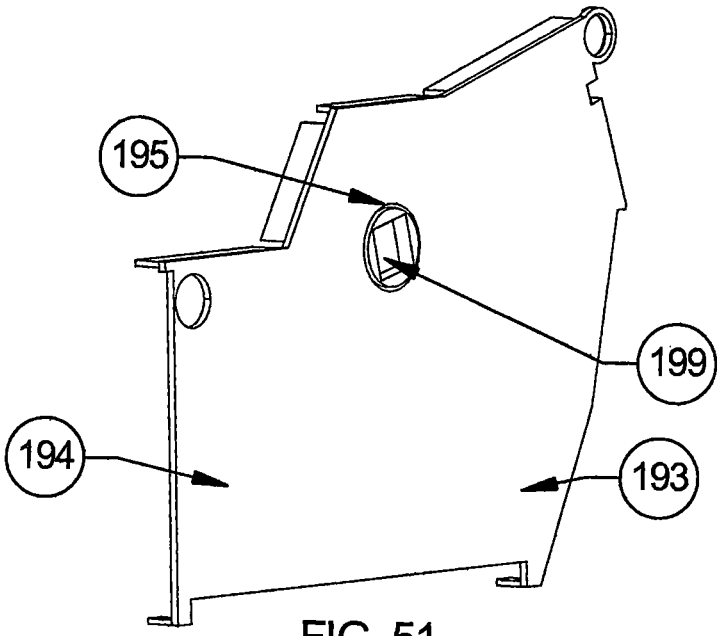
FIG. 51 is a perspective view of the right interior wall looking from inside the dispenser.

12. Sprocket: FIGS. 48 and 49 illustrate circular sprocket 196. Sprocket 196 has a round base or plate 197 from which, on one side, identified as the front side here, circular stub 198 protrudes at the center of base 197 whose thickness is greater than the thickness of right interior wall 192, the latter identified in FIG. 50. Circular stub 198 has a square hole 199 in its center the size which is designed such that square stub 206 of sprocket attachment device 204, the latter as identified in FIG. 52, tightly fits into it while the thickness of circular stub 198 is designed such that it allows its face to protrude into the round opening 195 in the right inner wall 192, the latter as illustrated in FIG. 51. The diameter of stub 198 is slightly smaller than opening 195 so that it combined with sprocket attachment device 204 can freely rotate about their common central axle. From the outer edge of base 197, radially protrude outward a number of rectangular teeth 200, whose count is determined by the count of and spacing between the fixed pins 187 and whose thickness is same as that of driver pins 190, the latter as shown in FIG. 45. On the back of the round base 197, opposite of its front side, as shown in FIG. 49, outer ring 201 protrudes out such that it has inner diameter large enough that it can smoothly rotate around the circular hat plate 175 of circular guide 174, when mounted on it, that is, guide 174, as shown in FIG. 51. From this back side of round base 197, also protrudes out another smaller ring, inner ring 202, at the center of sprocket 196. The outer diameter of ring 202 is slightly less than the inner diameter of hat 175 thereby allowing the sprocket 196 to rotate freely when mounted on to circular guide 174. FIG. 49 shows round inner hole 203 inside ring 202 that has no particular sizing need, this hole being created to save material.

Figure 52:
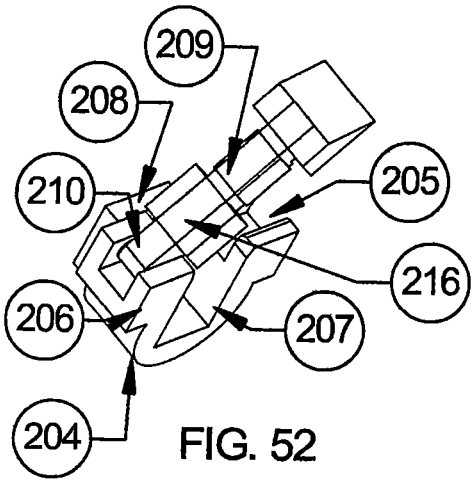
FIG. 52 is a perspective view of the front of partially open sprocket attachment device.
Figure 53:
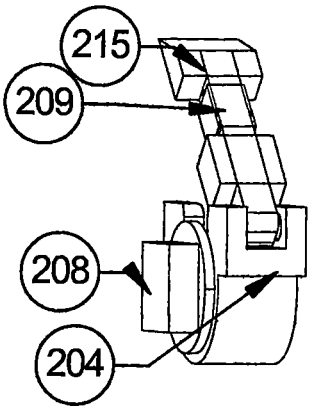
FIG. 53 is a perspective view of the back of partially open sprocket attachment device.
Figure 54:
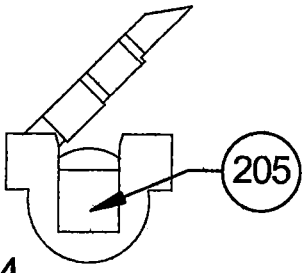
FIG. 54 is a front elevation view of the partially open sprocket attachment device.
Figure 55:
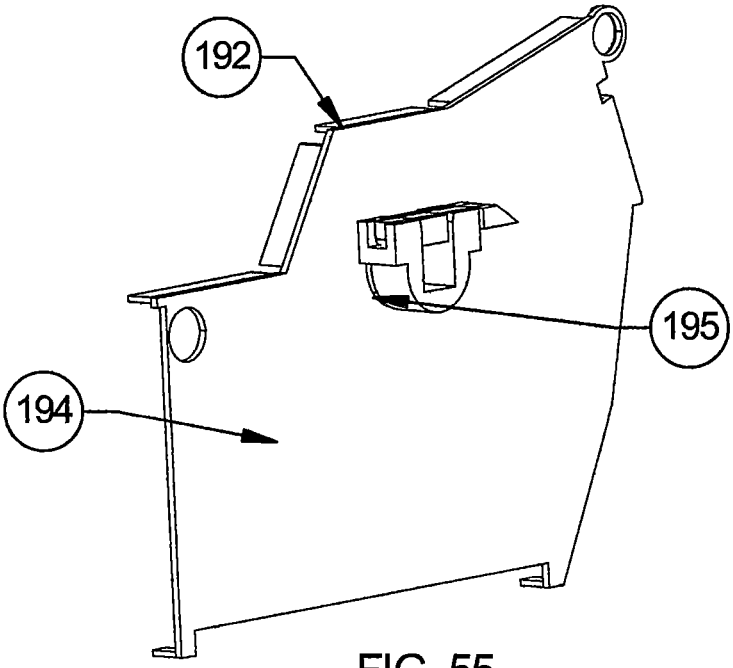
FIG. 55 is a perspective view of the back of the left interior wall.

13. Sprocket Attachment Device: FIGS. 52-54 illustrate a special sprocket construct that is called a sprocket attachment device 204 in this patent application. As shown in the perspective FIGS. 52 and 53, device 204 has a square cut open channel 205 running through its length, end to end, providing two walls 206 on two vertical sides of channel 205. Device 204 also has another open square cut 207, perpendicular to cut 205, running across the width of device 204, from its front face to back face, to the back wall of square stub 208, the latter being centrally located on square cut 207 and has depth and width that allows it to tightly fit into square hole 199 of sprocket 196 as described in the paragraph hereabove. Device 204 has rotatable arm 209 whose rear end 210 has two short cylindrical stubs 211 and 212 that are designed to rotate within two concentric holes 213 and 214 in rear walls 206 allowing the arm 209 to freely rotate about the axis of subs 211 and 212. The length of arm 123 is greater than the length of channel 205 such that its front end 215 sticks out of channel 205. Front end 215, shaped like the head of a hammerhead fish, has width greater than the width of channel 201. This allows easy moving of arm 209 up and down with the use of one finger or such simple touch. FIGS. 53 and 54 show the perspective and back elevation of the open position of arm 209. In the down or horizontal, closed position, arm 209 snugly fits in the opening created by channel 205 thereby this opening so created allows the square end 292 of fabric holder shaft 238 to snugly fit into it. The middle part of arm 209 is identically widened on its two sides, shown as wider mid-part 216, so as to provide better hold on the square end 292.

Figure 56:
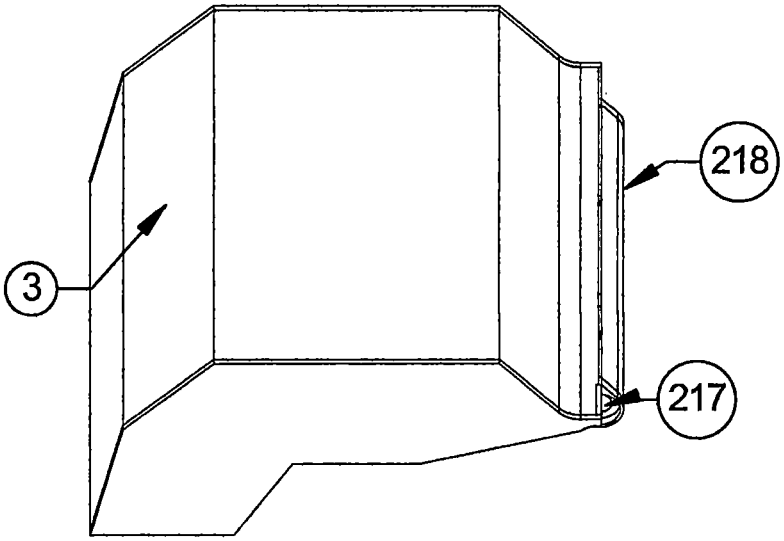
FIG. 56 is a perspective view of the top cover of the dispenser looking from above.
Figure 57:
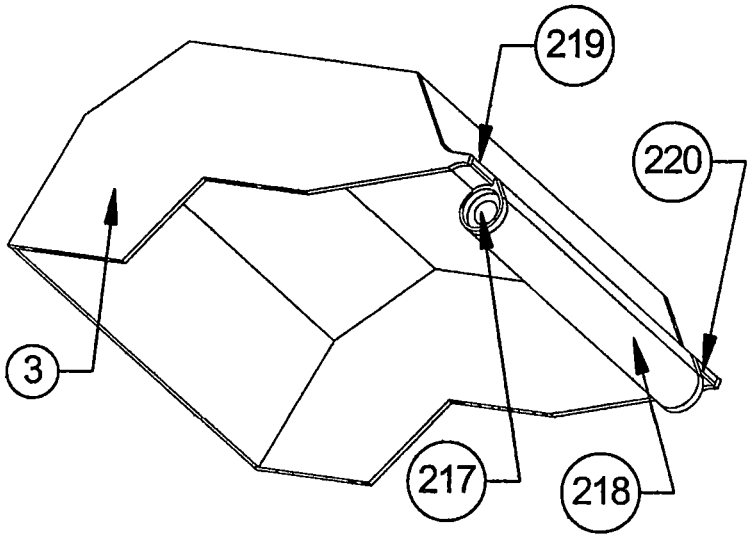
FIG. 57 is a perspective view of the top cover of the dispenser looking from below.
Figure 58:
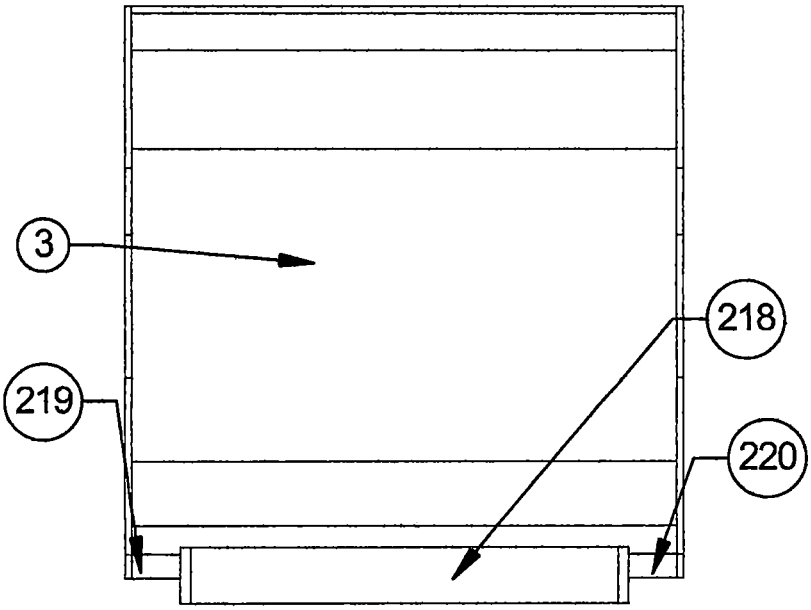
FIG. 58 is a plan view of the top cover of the dispenser.

14. Frame Cover: FIGS. 56-58 illustrate top cover 3 of dispenser without top tray 6. This cover 3 is shaped and designed to act as a top part of encasement 1 thereby providing a total cover for fabric roll 327. The front of cover 3 comprises round hole 217 that runs along the width of cover 3 thereby forming a round hollow pipe 218 though which is mounted front cover axle rod 325, the latter as shown in FIG. 95. When nuts 14 and 15 are screwed on to the two threaded ends of axial rod 325, nuts 14 and 15 first pass through holes 30 and 41, as shown in FIG. 4, and pipe 218 and are tightened just enough such that they allow cover 3 to freely rotate about the axis of the hollow pipe 218. Pipe 218 ends have open margins 219 and 220, by which pipe 218 is shorter than the width of cover 3 to allow width of right and left exterior wall 4 and 8 through which the axial rod 328 passes. These margins are clearly illustrated in FIG. 58. This allows cover 3 to open and close dispenser 1.

Figure 60:
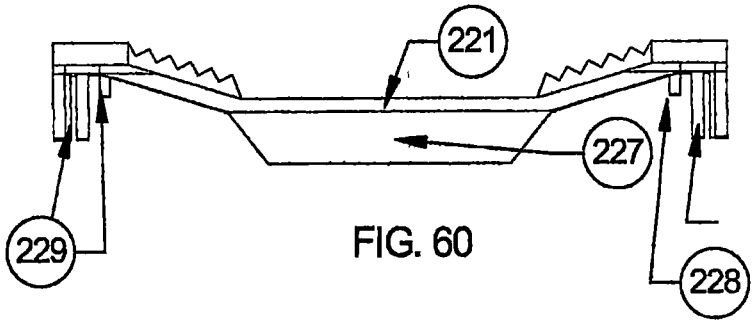
FIG. 60 is a front elevation view of the frame front handle.
Figure 61:
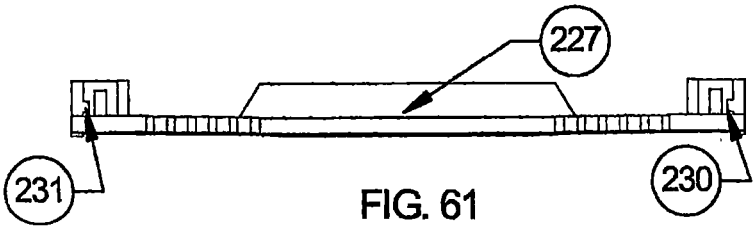
FIG. 61 is a plan view of the frame front handle looking from above.
Figure 62:
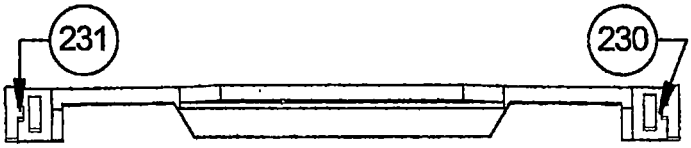
FIG. 62 is a plan view of the frame front handle looking from below.

15. Frame Front Handle: The details of frame front handle 221 are illustrated in FIGS. 59-62. FIG. 59 provides a perspective view of handle 221 that illustrates its two bracketed grooved ends 222 and 223 that connect to two levers 73 and 182 respectively, horizontal plate 224, sloped uneven, shown toothed, runs 225 and 126 on the left and right ends, central vertical stiffener plate 227 underneath the front of horizontal plate 224, vertical end plates 228 and 229, and horizontal hooking catches 230 and 231. Two grooved ends 222 and 223 are designed to fit into the matching cavities of the ends of the two lever extensions, that is, left lever extension 74 and right lever extension 183. The purpose of the uneven runs 225 and 226 is to discourage users from putting their hand on two sides of plate 224, but only centrally on plate 224, thereby avoiding a sidewise tilted movement of handle 5. End plates 228 and 229 along with horizontal catches 230 and 231, illustrated in FIGS. 60-62, help tightly lock front handle 221 into lever extensions 127 and 128; their combined constructs are as illustrated in FIG. 2. As shown in FIG. 60, plate 224 is at a lower level than its two ends 222 and 223 and as described here above, it is separated from them with sloped toothed runs 225 and 226. Pressing plate 224 causes the two levers, left lever 44 and right lever 103, to rotate toward the front of dispenser 1 which in turn rotates connected right sprocket attachment 204.

Figure 63:
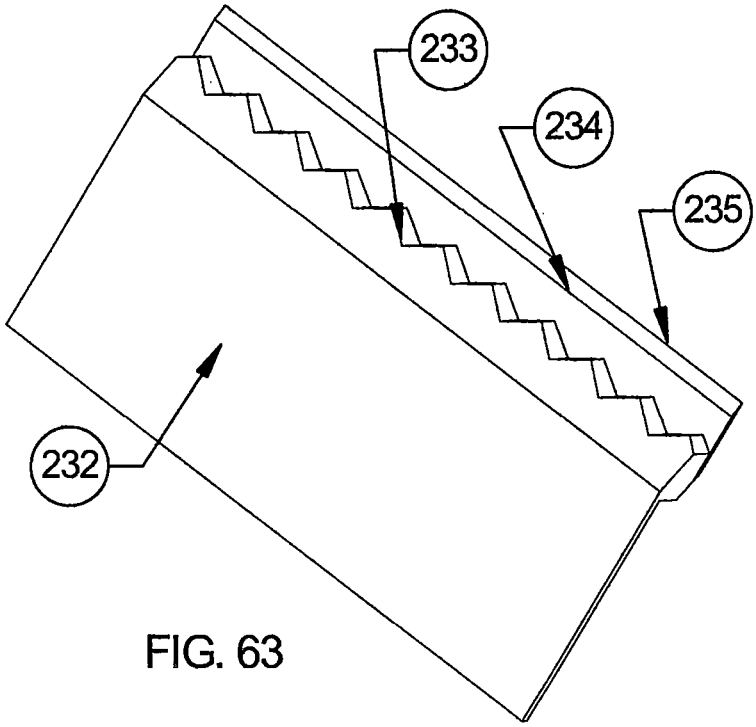
FIG. 63 is a perspective view of the middle slider connector looking from above.
Figure 64:
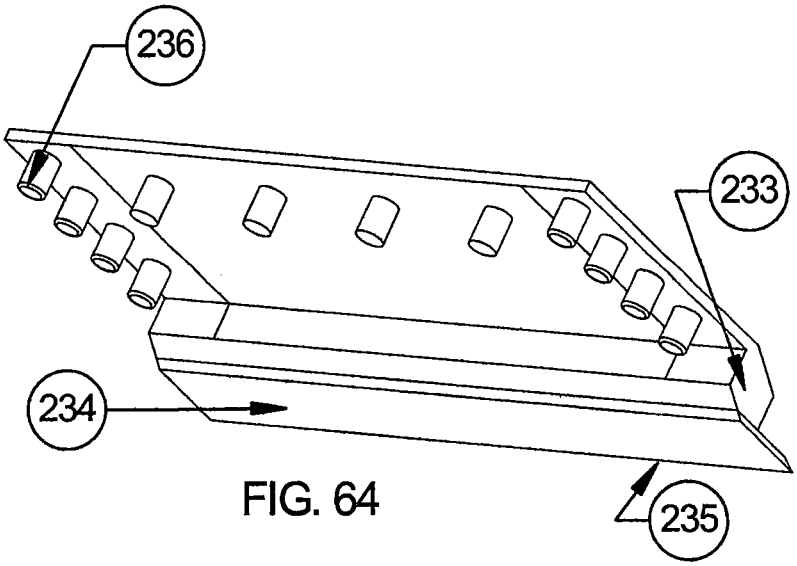
FIG. 64 is a perspective view of the middle slider connector looking from below.
Figure 65:
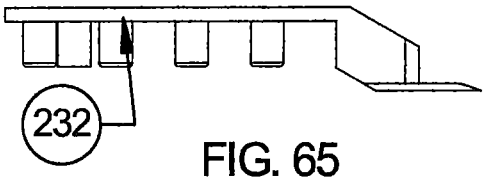
FIG. 65 is a side elevation view of the middle slider connector.
Figure 66:
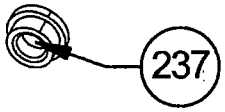
FIG. 66 is a perspective view of the middle slider connector pin cap.
Figure 67:
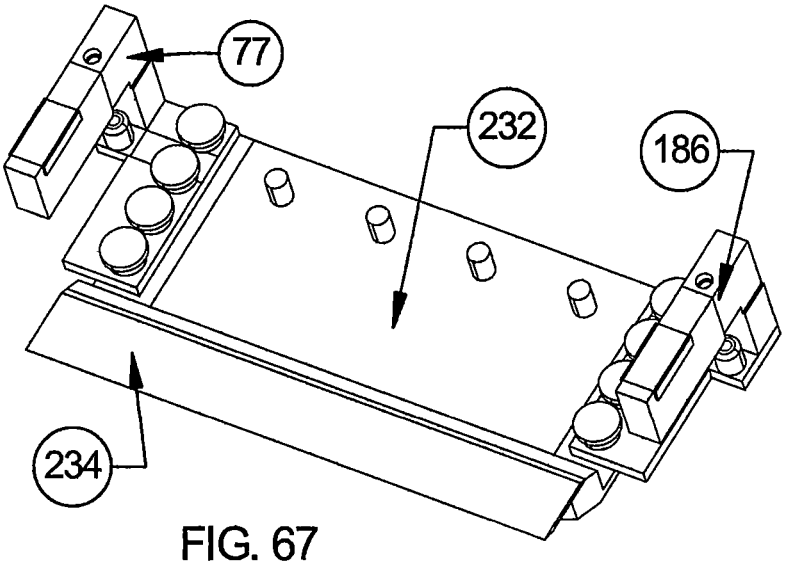
FIG. 67 is a perspective view from above of the middle slider connector assembly.
Figure 68:
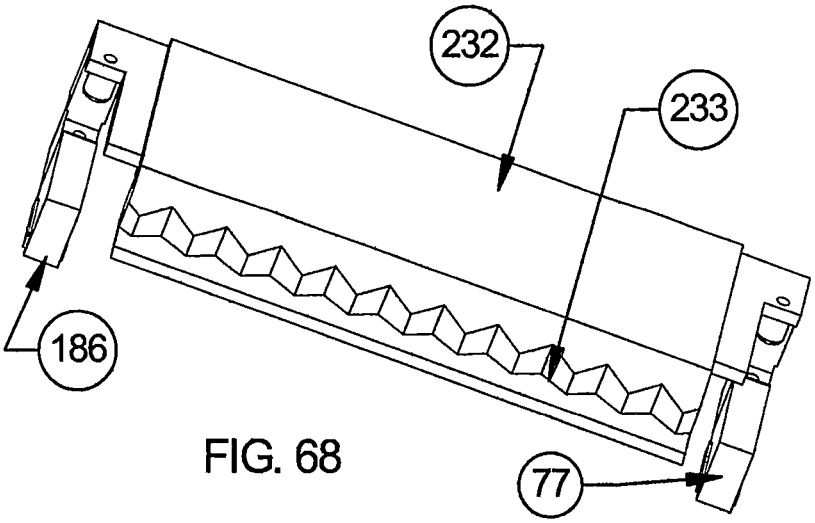
FIG. 68 is a perspective view from below of the middle slider connector assembly.

16. Middle Slider Connector Assembly: FIGS. 63-65 illustrate what is identified in this patent application as middle slider connector 232. These figures further illustrate its features and associated parts, while its assemblies with left slider connector 77 and right slider connector 186 are illustrated in FIGS. 67 and 68.

FIG. 63 illustrates jaws-like zig-zag shaped teeth 233 along the full length of middle connector 232 at the front of bottom plate 234, wherein the front part of plate 234 forms a sharp blade edge 235. A number of pins 236 protrude from the bottom face connector 232 as illustrated in FIGS. 64 and 65; the count of which pins depends on the size of frame 2. The size of connector 186 will depend on opening 42 which itself depends on the size of frame 2, as such larger dispensers will need larger slider connector 137 along with greater number of pins 140. Blade edge 235 helps the user of dispenser 1 to shear the unrolled fabric from the fabric roll 327 as the fabric comes out of dispenser 1 and hangs over the edge 235 as shown in FIG. 1. Pins 236 help attach connector 232 to respective left and right slider connectors 73 and 117 as shown in FIGS. 67 and 68. Each of pins 140, after it is inserted through its corresponding hole of slider connectors 73 and 117, is tightly capped with pin cap 237, the latter shown in FIG. 67.

Figure 69:
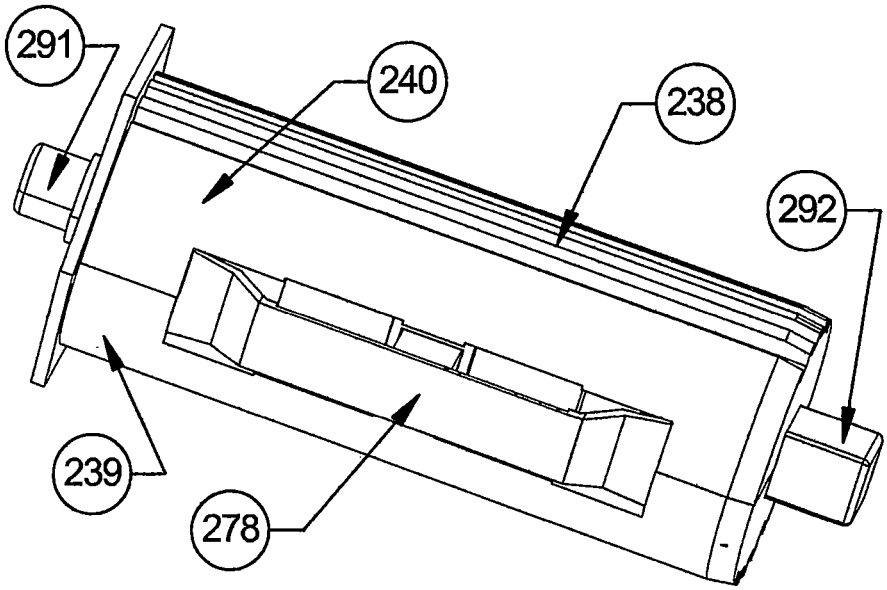
FIG. 69 is a perspective view of the fabric holder shaft assembly.
Figure 70:
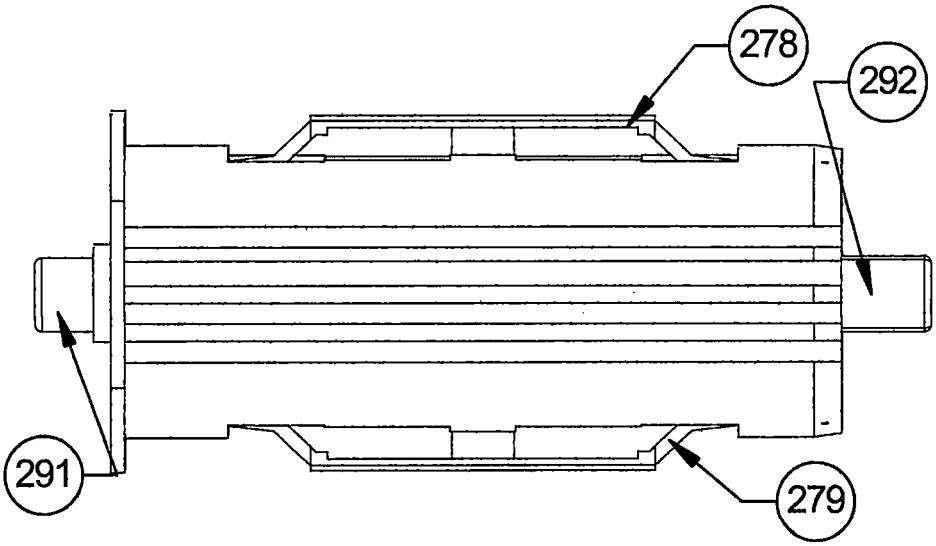
FIG. 70 is a plan view of the fabric holder shaft assembly.

17. Fabric Holder Shaft Assembly: FIGS. 69 and 70 illustrate fabric roll holder shaft 238, in its fully assembled form. In the following FIGS. 71-78, shaft 238 is shown in two halves: shaft bottom half 239 part as illustrated in FIGS. 71-74, and shaft top half 240 in FIG. 75.

Figure 71:
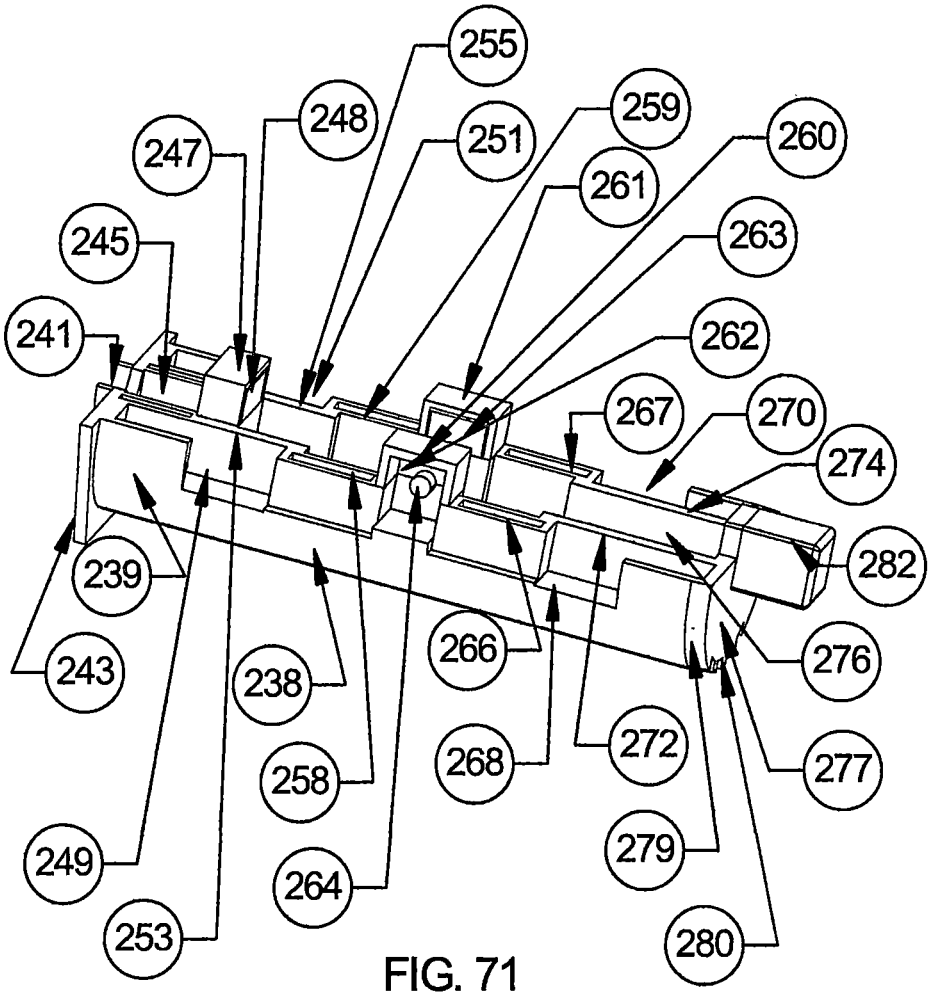
FIG. 71 is a perspective view of the bottom half of the fabric holder shaft assembly.
Figure 72:
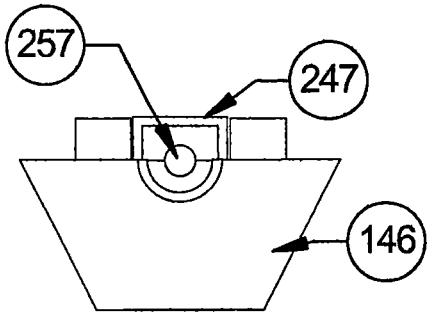
FIG. 72 is an elevation view from the round hole end of the bottom half of shaft.
Figure 73:
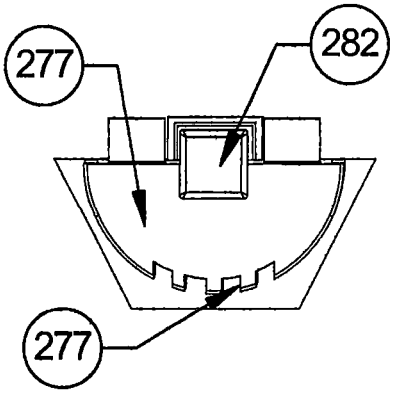
Figure 74:
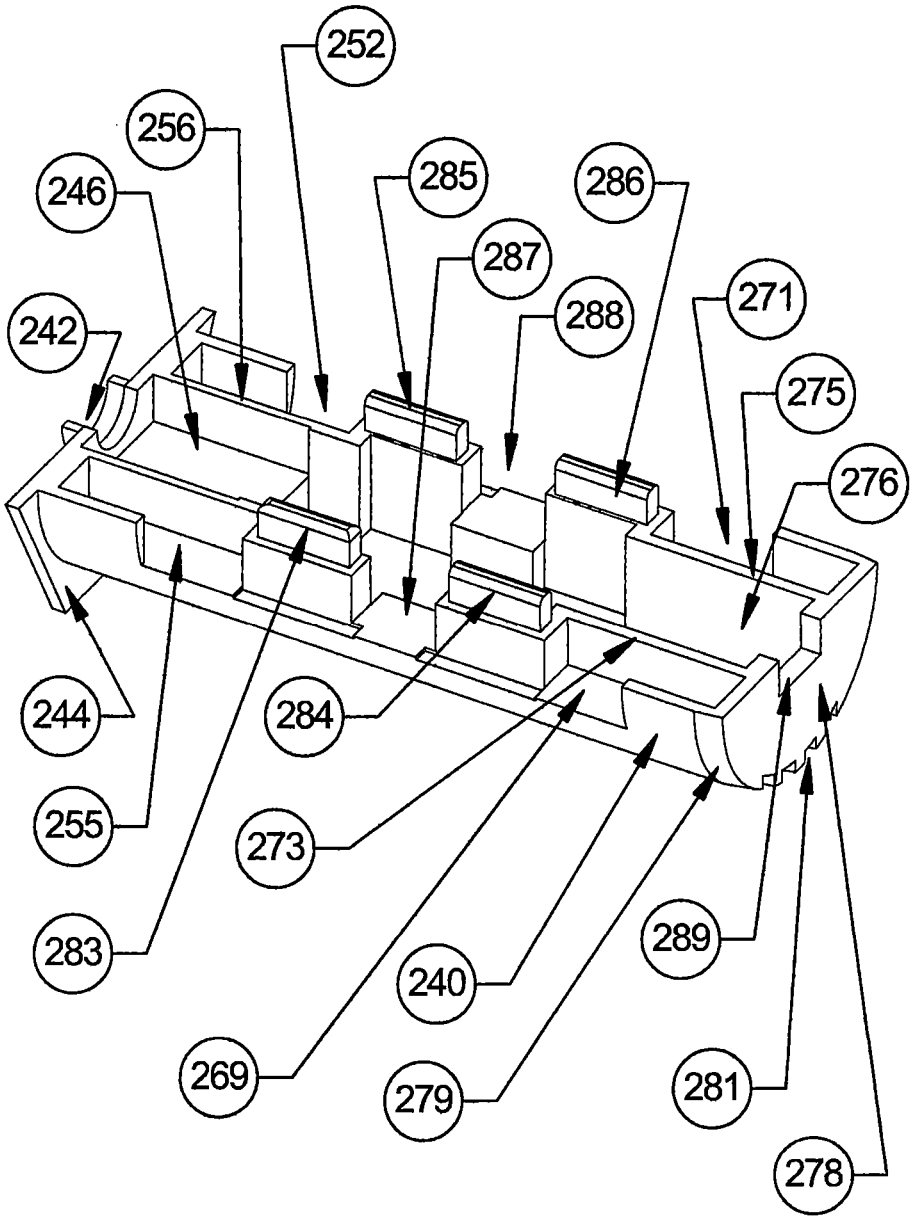
FIG. 74 is a perspective view of the top half of the fabric holder shaft assembly.
Figure 78:
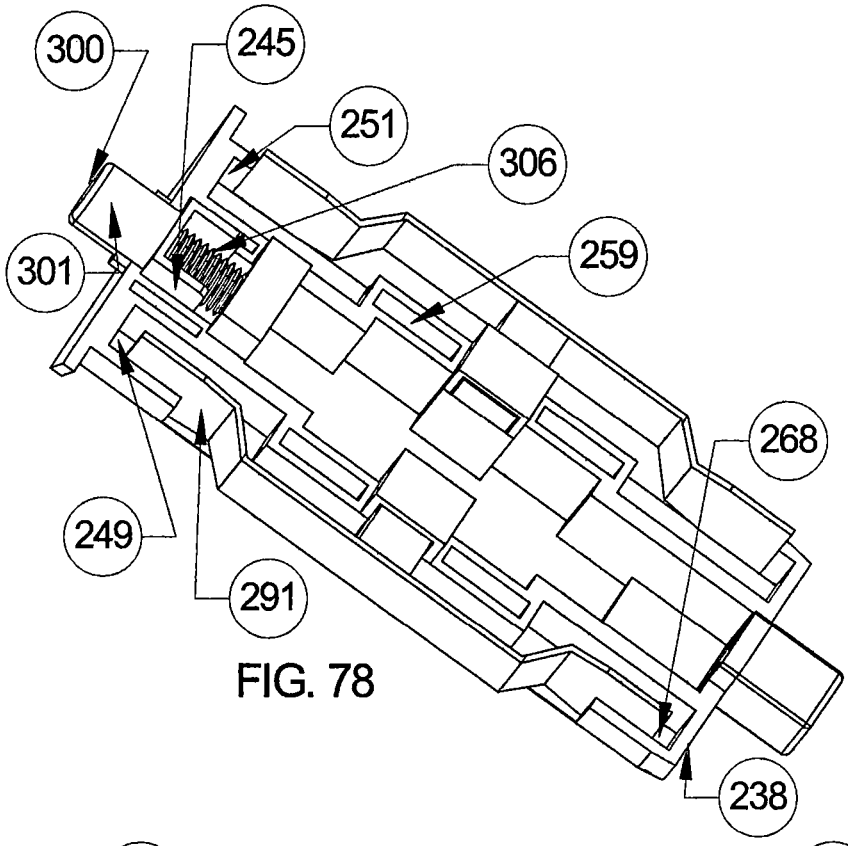
FIG. 78 is a perspective view of shaft bottom half assembly.

FIG. 71 illustrates details of bottom half 239 comprising circular lower lip extension 241 at its left most end. This is also shown in FIGS. 72 and 73. This lower lip extension 241 has its corresponding upper lip extension 242 in the shaft's top half 240, the latter as shown in FIG. 74. FIG. 71 shows also at the left end, vertical flat plate identified as lower stop 243, situated just right of lower lip extension 241, this lower stop 243 also having its corresponding upper stop 244 situated right after upper lip extension 242, both stops having the same circular shape opening as respective lip extensions 241 and 242. The round openings in lower and upper lip extensions 240 and 241 along with the lower and upper stops 243 and 244, in their combined configuration as a single part of shaft 238, form a round opening through which pin 300 moves, as shown in FIG. 78. Needless to say, this round opening has a radius slightly larger than cylindrical head 301 of pin 300 radius for smooth movement of the latter in and out of shaft 238. The primary purpose of stops 243 and 244, in their joined configuration, is to prevent the sliding of mounted fabric roll 327 out of shaft 238 at this end.

FIG. 71 additionally illustrates left end lower rectangular cavity 245 which also has its corresponding upper rectangular cavity 246 as shown in FIG. 74, wherein in the joined configuration of shaft bottom half 239 and shaft top half 240, these cavities together provide long and wide enough open space to accommodate pin 300 and allow its free movement along the length of shaft 238. FIG. 71 shows end square box 247 at the right end of cavity 245 that has no front wall but has back wall 248. On the two sides of cavity 245 are two additional rectangular cavities: lower side cavities 249 and 251. These cavities have their respective and corresponding upper side cavities 250 and 252. In the bottom half 239, cavities 249 and 251 are separated by side walls 253 and 255 and in top half 240, cavities 250 and 252 are likewise separated by their corresponding side walls 255 and 256 respectively. FIG. 71 also shows the backwall 248 of box 247. Inside box 247, on the center of its back wall 248, situated is round stub 257 as shown in the elevation of this end in FIG. 72.

There are two wall pockets 258 and 259 that are situated to the right of side wall cavities 249 and 255. Following down the length of shaft bottom half 239 toward right of FIG. 71, there are two side square boxes 260 and 261 which are configured like end square box 247 that they have back walls 262 and 263 on which are mounted round subs, called side stubs 264 and 265 respectively in this patent.

There are two wall pockets 266 and 267 that are situated right after side square boxes 260 and 261 on shaft bottom 239 which are followed by two side wall cavities 268 and 270 with their corresponding cavities 269 and 271 on the shaft top 240. As is evident from FIG. 71, all four wall pockets are identical as are the four sidewall cavities, in their respective size and configuration. Also, side walls 272 and 274 have counter parts 273 and 275 very much like the above-described side walls 253-256.

As shown in FIG. 71, there is a long weight reduction channel cavity 276 that runs the full length of bottom and top halves of shaft 238 from the wall represented by stops 243-244 at the left end to the wall represented by circular wall halves 277 and 278, the latter half being in the shaft top 240. These wall halves are tapered to a narrow width taper 279 all around. Grooves 280 on the bottom of bottom half 239 and 281 on the top of top half 240 are provided end-to-end for providing better grip of the fabric roll 327. Finally, square pin 282 is situated at the right end of shaft 238; this pin 282 being used for mounting the shaft into square cut 207 of right sprocket attachment 204 as shown in FIG. 54 and described hereabove.

Moving on to FIG. 74, this figure presents top half 240 part of shaft 238 and all its features. Most features starting with top lip extension 242 all the way to sloped end 281 have been identified and illustrated in the above paragraphs as corresponding features in the description of the lower half 239 part of shaft 238. The features that are new are identified here.

Figure 79:
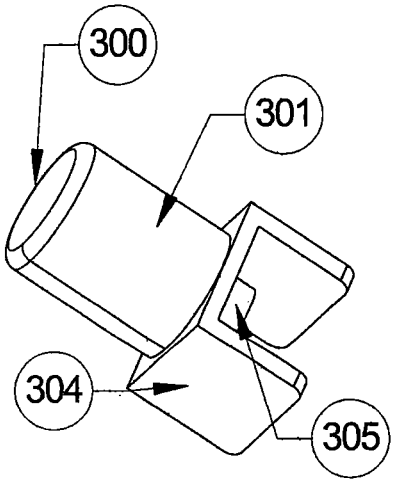
FIG. 79 is a perspective view of the end pin.
Figure 80:
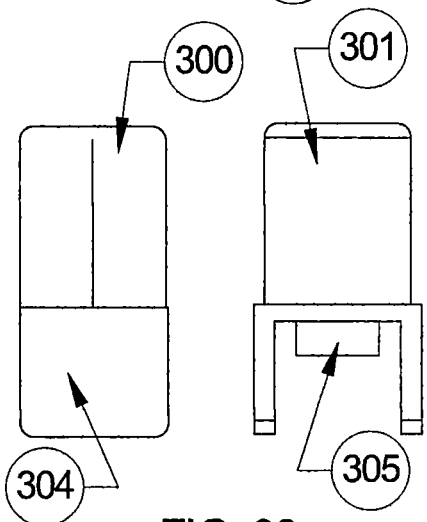
FIG. 80 is an elevation view of the end pin.

Left end upper rectangular cavity 246 is sized large enough to accommodate side walls 303 and 304, as illustrated in FIGS. 79 and 80, and end square box 247, as illustrated in FIG. 71. Four identical rectangular inserts 283-286 are located matching the location of four sidewall pockets 258-259 and 266-267 in bottom half 239. These inserts 283-286 in top half 240 have tapered ends and have the size and shape such that they tightly fit into their corresponding wall pockets 258, 259, 266 and 267 in bottom half 239 when two halves 239 and 240 are put together as described below in the operation section. FIG. 74 shows end square pin cavity 289 at the far right end which is provided to accommodate top half of end square pin 282.

Figure 75:
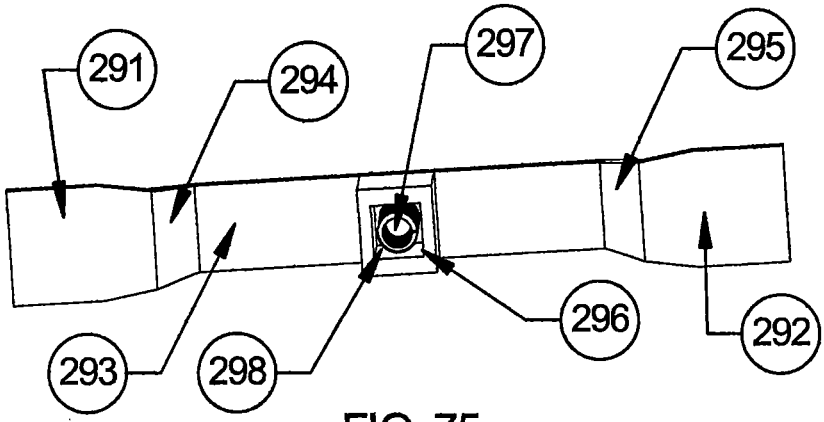
FIG. 75 is a perspective view of the shaft stopper bar.
Figure 76:
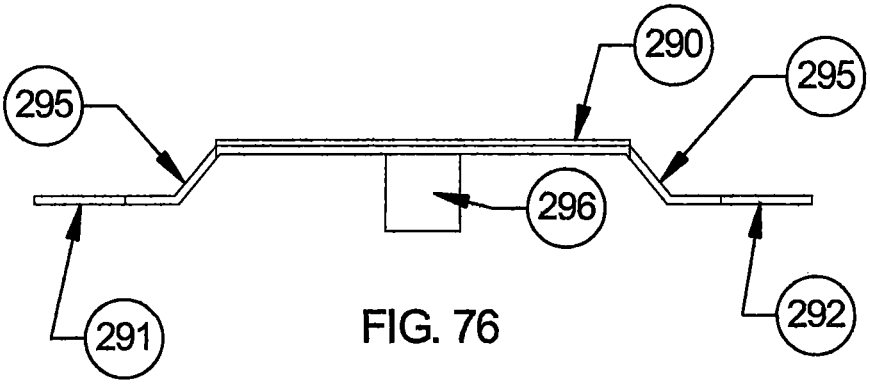
FIG. 76 is an elevation view of the shaft stopper bar.
Figure 77:
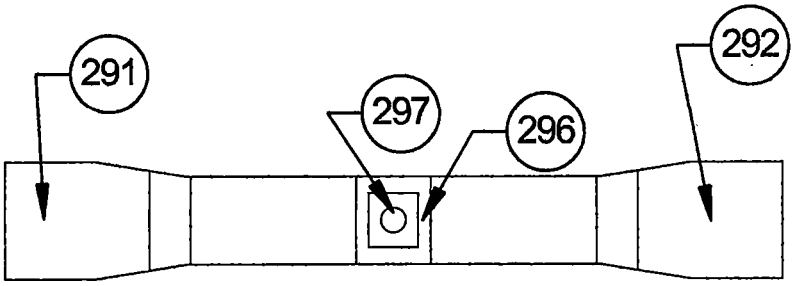
FIG. 77 is a plan view of the shaft stopper bar.

FIG. 75 illustrates what is identified in this application as shaft stopper bar 278 which is an external body that is placed parallel to the length of the body of shaft 238. Stopper bar 278 is essentially a long thin flat plate 290 that has at its two ends two wide flaps 291 and 292 that are joined to the narrower mid-part 293 with tapering bent side parts 294 and 295, one at each end, that are at a different plane. The difference between the plane of mid-part 293 and that of the two flaps 294-295 is shown in the side elevation view of stopper bar 278 in FIG. 76. Stopper bar 278 has square box 296 centrally located on the inner face of mid-part 293 as shown in FIGS. 75-77. At the center of box 296 is a round stub 297 that also projects out of the inner face 184 of mid-part 293. This stub 297 is meant for mounting compression spring 298. Spring 298 has one end mounted on stub 289, as illustrated in FIG. 71, and the other end, on identical stub 265 identified in FIG. 71. So, two copies of stopper bar 278 are built and placed in sidewall cavities 249 and 268 on one side of shaft 278, and 251 and 269 on the other, as shown in FIG. 78. When so assembled, within the body of shaft 238, they move in and out of the body of shaft 238. Not unlike the behavior of other compression springs described here above, the two duplicates of spring 298 keep two copies of stopper bar 278 pushed out of the body of the shaft 238 in normal condition and resist any movement inward, into the body of shaft 238, when external pressure is applied. The outer face of mid-part 293 has a curvature 299 that has the same radius as shaft 238 as shown in FIG. 76. This curvature 299 allows smooth mounting of the fabric roll 327.

18. End Pin: FIGS. 79 and 80 illustrate what is identified as end pin 300 in this patent. End pin 300 is an external body that is mounted in left end lower cavity 245 of shaft 238 as shown in FIG. 78. Pin 300 comprises solid cylindrical head 301 which has a radius a bit lower in value than bottom lip extension 241 and its counterpart top extension 242 such that head 301 sits snugly in the combined cylindrical opening of extensions 241 and 242, the latter two parts shown in FIGS. 71 and 74, when the bottom half 239 and top half 240 of shaft 238 are joined together. Cylindrical head 301 has its bottom attached to thin flat square base 302 which itself has two thin side walls 303 and 304 at its back face. On this back face of base 302 is located short round stub 303. This stub allows the mounting of short compression spring 306, as shown in FIG. 78, which in normal condition pushes end pin 308, that is, front face of its base 302, against the inside faces of lower stop 243 and upper stop 244. This is designed to allow snug positioning of the outer part of head 301 between curved walls 150 and 151 and on curved floors 125, and 131 combined, of bracket assembly 89, the latter as illustrated in FIG. 28.

Figure 81:
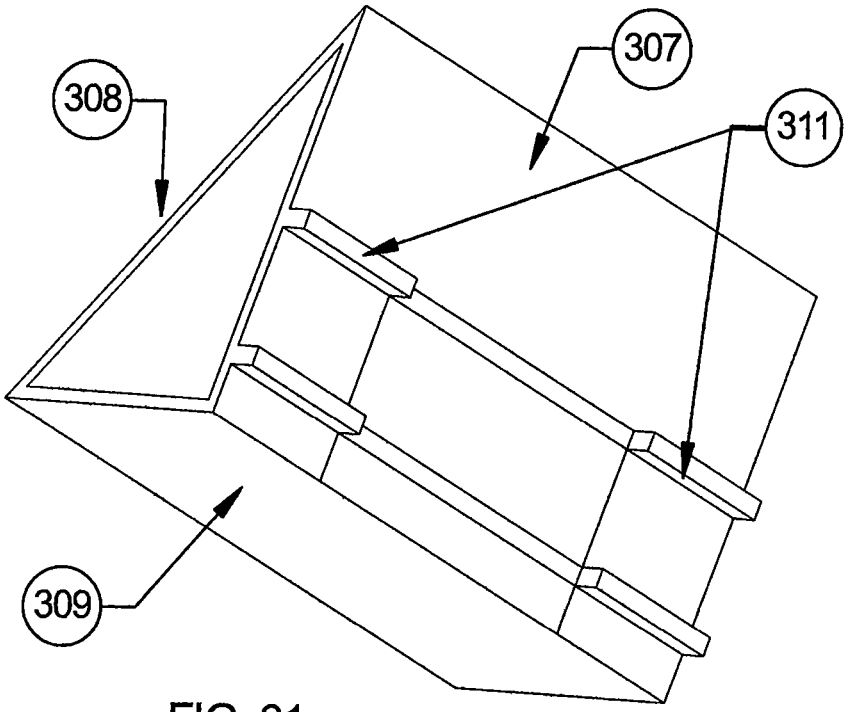
FIG. 81 is a perspective view of the sloped back support.

19. Sloped Back Support: To enhance a smooth flow of the dispensed fabric at the back of the fabric roll 327 and prevent its entanglement with the back wall and the floor of frame 2, a bracket called sloped back support 307 in this patent is provided as shown in FIG. 81. Support 307 can be either an integral part of frame 2 or a stand-alone part that is integrated with frame 2 by mounting it on frame 2 as described here. Its side elevation is shown in FIG. 82.

Figure 82:
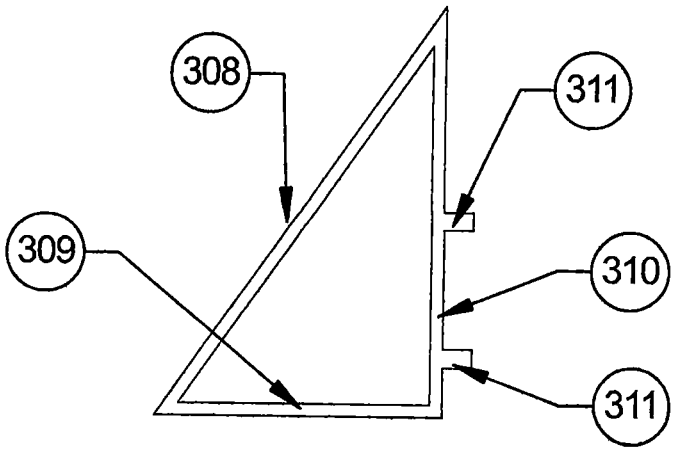
FIG. 82 is an elevation view of the sloped back support.

Support 307 has a sloped front face 308, a horizontal floor 309, and vertical backwall 310 all joined to form a triangular cross-section as shown in both FIGS. 81 and 82. In the design shown, support 307 is a stand-alone part. Its backwall 310 has multiple rectangular projections 311 that have the same count and shape as holes 22 of dispenser frame 2 depicted in FIG. 3. Projections 311 are thus designed to allow them to tightly fit into their corresponding holes 22 and thereby making support 307 become an integrated part of dispenser frame 2.

Figure 84:
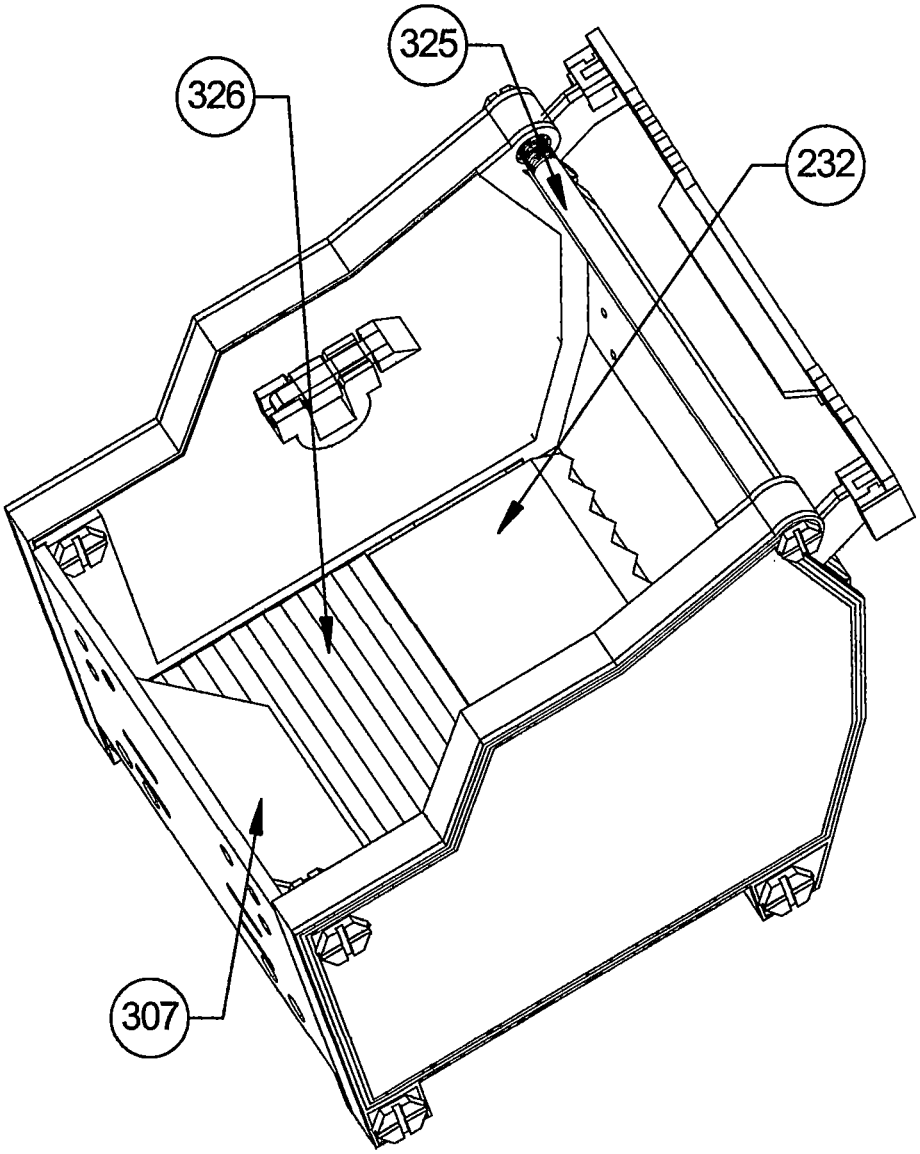
FIG. 84 is a perspective view of the dispenser without the cover and fabric roll.

Needless to say, if support 307 is built as an integral part of frame 2, then neither backwall 310 and its rectangular projections 311 are needed nor is there a need for holes 22 in frame 2. The front face 308 and floor 309 are however needed and they would project out of the inner face of the backwall of frame 2. A perspective view of dispenser 1, without its cover, comprising support 307 is shown in FIG. 84.

Figure 83:
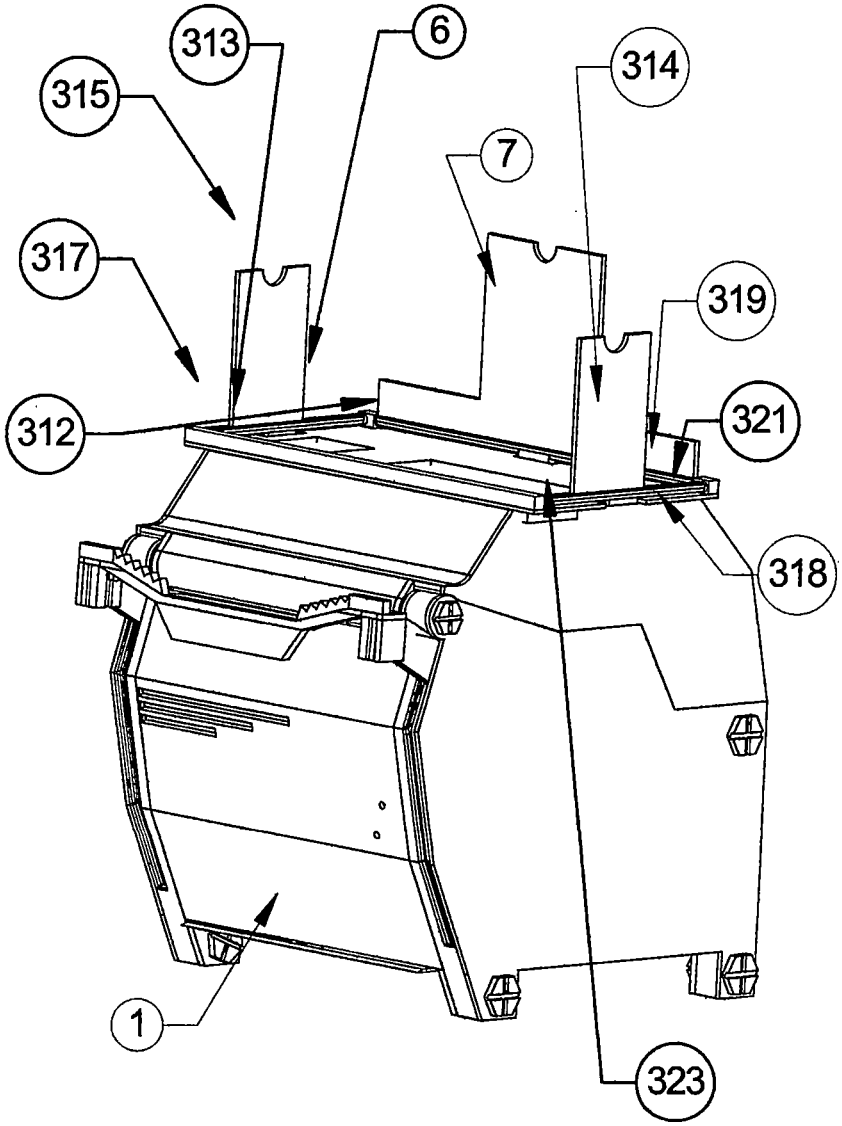
FIG. 83 is a perspective view of the top tray assembly on dispenser cover.

20. Dispenser Top Tray Assembly: FIG. 83 as well as FIGS. 1-3 illustrate top tray 6, for holding electronic gadgets like a smartphone, tablet, radio, non-electronic items like a ring of keys, notebook, purse, small tool, and such other handy items. Tray 6 comprises base frame 313, fixed floor plate 312 situated on base frame 313, foldable central cover plate 7 and two foldable side cover plates 314 and 315. Plates 7, 314 and 315 fold forward about their bottom horizontal axes 316-318 that run parallel to the corresponding edges of cover frame 313. Side cover plates 314 and 315 have short vertical lips 319 and 320 that prevent plates 314 and 315 from tilting or unfolding backward away from floor plate 312. Lips 319 and 320 extend through rectangular holes 321 and 322 in the floor plate 312. When opened or unfolded to the vertical position, the cavity formed by plates 7, 314 and 315 on three sides provides a temporary but convenient storage space for the handy items and prevents them from falling down from the top of tray 6.

Like sloped back support 307 described here above, top tray 6 can be either an integral part of top cover 3 or installed on cover 3 to form an integrated part of cover 3. In the latter case, frame extensions 323 and 324 on two sides of tray 6, the latter as shown in FIG. 83, help tray 6 to tightly fit on to the top horizonal part of cover 3. If tray 6 is built as an integral part of cover 3, extensions 323 and 324 are not needed.

Dispenser Operation

Having thus described above the individual parts and their assemblies, herein is described the final assembly of the full dispenser system 1. After the left exterior wall assembly is put together (FIG. 14), the left interior wall 71 is mounted on it by inserting its parapet walls 81, 82, 86 and 87 into corresponding channel 54 of left exterior wall 8. The two walls are firmly attached together by inserting right sized nuts and screws through left exterior wall holes 60-62 (FIG. 12) and corresponding hole 79 on left interior wall 192 (FIG. 16) and 37, 38 and 40 (FIG. 8). Bottom plate 154 now projects out from interior wall 71 bottom opening 91. Next, the shaft holder bracket assembly (FIG. 28) is mounted on interior wall 71 by inserting 126-128 (FIG. 30) into holes 83-85 (FIG. 16). Right exterior wall 4 assembly is similarly put together as shown in FIG. 45 and then right interior wall 192 (FIG. 50) is mounted on it. Square stub 206 of sprocket attachment device 204 (FIG. 52) is then inserted into square hole 199 (FIG. 48) which protrudes out of wall 192, the final assembly is as shown in elevation view FIG. 50 and in perspective view in FIG. 85.

Next, dispenser cover 3 (FIG. 56) is installed by inserting rod 325 (FIG. 84) into holes 63 (FIGS. 10-13) and 80 (FIGS. 15 & 16) on the left side walls, through cover hole 217 (FIGS. 56 & 57) and hollow pipe 218 (FIG. 15) and then corresponding right exterior holes (FIGS. 43, 44 & 50) after positioning cover 3 properly in between the two left and right interior walls. The threaded end of rod 325 is then gently tightened with a nut as shown in FIG. 84. Front handle 5 is installed by inserting its two grooved ends 222 & 223 (FIGS. 59-62) into grooved stubs 105 (FIGS. 18, 20-22) making sure that the vertical plate 227 (FIGS. 59, 60 & 62) is vertical and on the outside away from the dispenser 1 body. Finally, as shown in FIG. 67, middle slider connector 232 (FIGS. 63-65) is connected to two slider connectors on two sides by matching pins 236 (FIG. 64) with corresponding holes (FIG. 37).

Sloped back support 307 (FIG. 81) is installed on to the back wall of frame 2 (FIG. 3) by placing inserts 311 (FIGS. 81 & 82) of support 307 into horizontal holes 22 of frame 2, resulting assembly being shown in FIG. 84. Additional collapsible plate 326 (FIG. 84) is attached to the bottom of support 307 and connected to back pins 235 (FIG. 64) to fill the gap between the back of middle slider connector 232 (FIG. 63) and the front edge of bottom horizontal floor 309 (FIGS. 81 & 82) thus making the dispenser 1 airtight.

Figure 86:
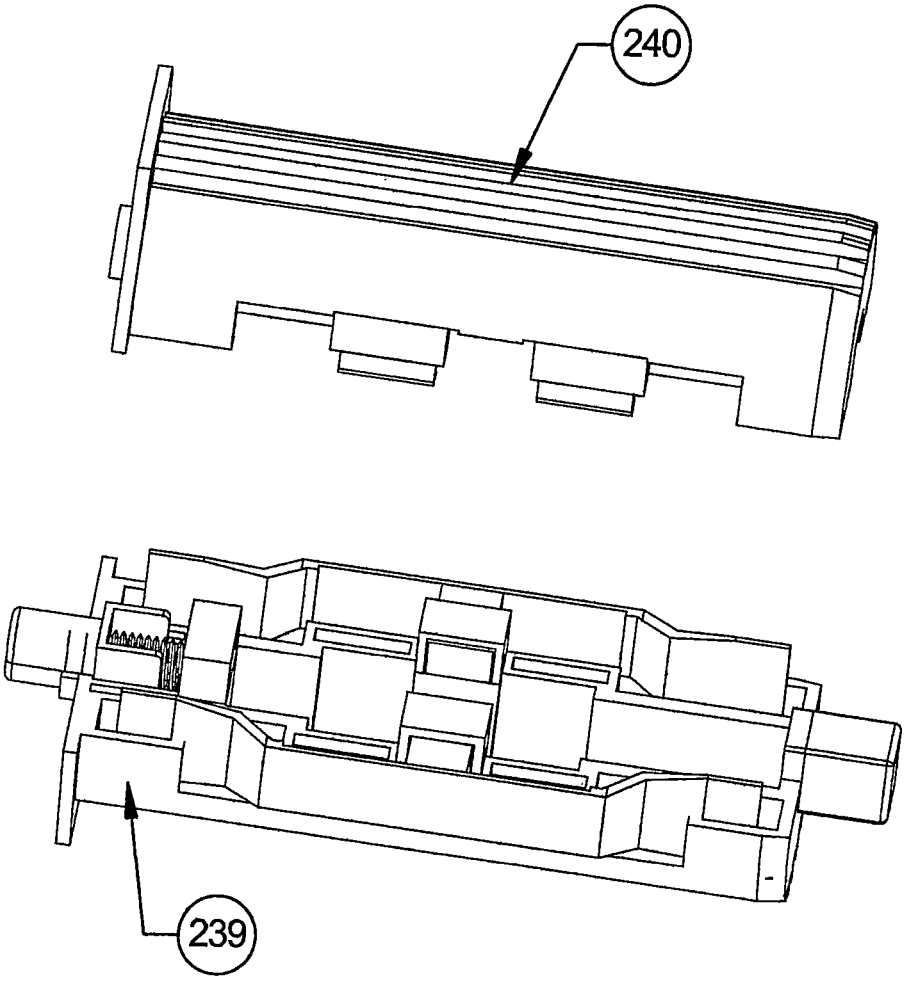
FIG. 86 shows perspective view of the pre-joined fabric shaft top and bottom halves.
Figure 87:
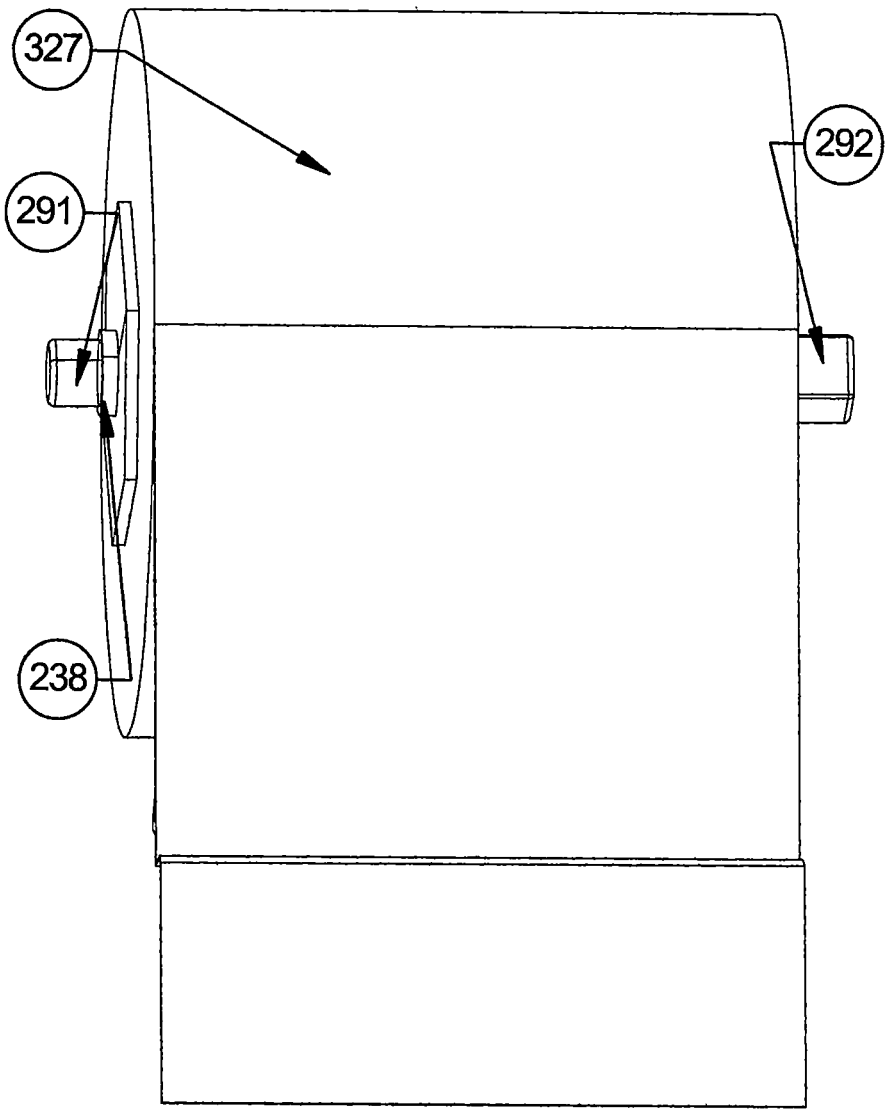
FIG. 87 shows perspective view of the fabric roll mounted fabric holder shaft.

Fabric holder shaft 238 (FIGS. 69 & 70) is then assembled by placing top half 240 (FIG. 74) onto bottom half 239 (FIG. 71), the combined shaft configuration as shown in FIG. 86. Roll 327 is then inserted onto the shaft 238, from the square pin end 292 (FIG. 69) all the way to the roll stop, joined 243 and 244 stops (FIGS. 71 & 74) with the fabric web unfurled in the counter-clockwise direction looking toward the stop as shown in FIG. 87. Following this assembly, top tray 6 is installed on cover 3 (FIGS. 2 & 3).

Into assembled dispenser 1 (FIG. 1), roll 327 (FIG. 87) mounted on shaft 238 (FIG. 87), is then installed by opening the cover 3 (FIG. 3) of dispenser 1 (FIGS. 1-3) such that round pin end 291 (FIG. 69) sits snugly in curved floor 125 (FIG. 29) of bracket assembly 89 (FIG. 28). On the other side, arm 209 of sprocket attachment device 204 (FIG. 52) is opened and square pin end 292 of shaft 238 (FIG. 69) is placed in it and the arm pushed down to tightly close square cut 207 (FIG. 52).

Having thus assembled the whole dispenser system 1 (FIG. 1) along with shaft 238 (FIGS. 69 & 70) containing fabric roll 327 (FIG. 87), the dispensing operation works as follows. In the normal inactive mode, middle slider connector 232 (FIG. 63) keeps frame 2 floor opening 42 (FIG. 4) closed, wherein front teeth 233 (FIG. 63) sit tightly meshed with floor teeth 51 (FIG. 9) of frame 2 (FIG. 4). To start the dispensing operation, cover 3 (FIG. 2) is opened and web from roll 327 (FIG. 87) is pulled down toward the front of dispenser 1 (FIG. 2) freeing a portion of it from the roll as the forward movement of roll 327 is free movement as the forward movement is unencumbered by the gear train system.

Front handle 5 (FIG. 59) is then pushed down which in turn rotates levers 73 (FIG. 14) and 182 (FIG. 45) on its two sides, their legs pushing with their leg faces (left lever leg face 102 identified in FIG. 19) their respective slider connectors 37 (FIG. 14) and 186 (FIG. 45), toward the back of the dispenser 1 proportionately stretching springs 76 (FIG. 14) and 185 (FIG. 45) which in turn move connected middle slider connector 232 to the back thereby opening up the bottom floor opening 42 (FIG. 4) disengaging front teeth 233 of middle slider connector 232 (FIGS. 63-65) from teeth 51 of frame 1 (FIG. 4), the opening having been created then clears the free web through it. As handle 5 (FIG. 59) is released, it moves back up, relieving stretched springs 76 (FIG. 14) and 185 (FIG. 45), which in turn relieve levers 73 (FIG. 14) and 182 (FIG. 45) helping middle slider connector 232 (FIG. 63) to move to the front thereby tightly meshing its teeth against the frame 2 teeth 51 (FIG. 4) clasping the dispensed between the two rows of meshed teeth. The dispensed web that now hangs between the meshed teeth and over blade edge 235 (FIG. 64) of connector 232 (FIG. 64) and is now available for user to tear off. Following this dispensing operation, cover 3 (FIG. 2) is now closed.

The routing of the web in bidirectional planes, first through the meshed teeth 233 (FIGS. 63-65) in the vertical plane and then over plate 234 (FIG. 64) in the horizontal plane, doubly prevents slippage of the web while the blade edge of connector 232 (FIG. 64) adds to the ease of its tear. The dispensed web is now available for tear by the user. If the dispensed web length out of the dispenser 1 (FIG. 1) is not adequate, the user need only repeatedly push down and release handle 5 (FIG. 1) to release as much web as needed. In every move of the front handle 5, the user can push it down all the way to the bottom of openings 9 and 10 (FIG. 2) and release it so as to release greater length of dispensed web.

The invention claimed is:

1. A dispenser for dispensing a web from a roll of material comprising: an encasement housing a roll of fabric mounted on a rotatable shaft, the encasement comprising an open floor for dispensing the web, the encasement further comprising two side exterior walls, a back wall, a front wall and a rotatable top cover, the floor opening comprising a jaw with teeth along its front end, the side exterior walls each enclosed by a corresponding removable interior wall forming a compartment on each side of the encasement, the exterior walls each further comprising two parallel parapets on all edges of its interior face forming a contiguous channel in-between, the parapets of each exterior wall extended to the inner face of each interior wall, the interior walls each also having parapets near all its edges except at its bottom, the interior wall parapets allowing their insertion into external wall channels for attachment, the exterior and interior walls each further having holes for inserting nuts and screws to enduringly attach the interior walls to the exterior walls and hence to the dispenser, the parallel parapets of exterior and interior walls having slits at the front of the encasement, the interior walls each having a horizontal narrow opening at its bottom located above the bottom parapet of each exterior wall, the exterior walls each comprising a circular guide on its inner face, the interior walls each having a hole axially aligned with the circular guide, the interior wall on one side of the encasement further having a number of holes on its exterior face, the parapets of each interior and exterior wall and the adjoining face of the interior wall having a notch for helping its detachment from the encasement, the exterior walls each comprising a short stub on its bottom parapet, the encasement having a shape to help accommodate volume of the web roll, the back wall having holes for mounting the dispenser, the back wall further having holes for mounting a support bracket for directing flow of the web when needed, the rotatable top cover comprising a top container tray.

2. The dispenser of claim 1 wherein the encasement comprising a movable central bottom plate partially covering the encasement open floor, the bottom plate having a jaw of teeth along its front end, the teeth matching the encasement floor teeth and meshing with them in the forward position, the bottom plate further comprising a flat blade protrusion below the teeth to enhance tearing of the dispensed web, the bottom plate further comprising an assortment of pins at its bottom, the pins designed to fit holes in other members of the dispenser, the other members comprising a collapsible plate further connected between the back of the central bottom plate and the back wall of the dispenser, the other members further comprising two movable connector devices on two sides of the central bottom plate.

3. The dispenser of claim 1 wherein the encasement comprising in its each exterior wall compartment one each movable connector device, the each connector device comprising a floor plate that glides on the top of the bottom inner parapet of the exterior wall, each floor plate jutting out of the compartment through the bottom opening of the interior wall, each floor plate's portion outside the compartment having several holes, the holes aligning with the pins of the central bottom plate for connecting the connector device on each side to the central bottom plate, each connector device comprising a short stub, the short stub each facilitating the mounting of a spring between itself and the stub on the bottom inner parapet of the exterior wall, each spring ensuring the central bottom plate is pulled or pushed, depending on the compression or tension nature of the spring installed, in its released state to the front of the floor opening meshing its teeth with the encasement floor teeth to form a tight grip on the dispensed web, the connector further comprising a vertical arm connected to its floor plate, the vertical arm having a horizontal extension pointed toward the front of the dispenser, the horizontal extension pushing the leg of a unidirectional lever system that allows only dispensing of the fabric web.

4. The dispenser of claim 1 wherein a bracket device is mounted on the external face of one of the two interior walls to provide an implement for mounting of the fabric roll's shaft end, the bracket device comprising a base plate and a cover plate, the base plate being thicker in its lower part, the thicker part having a central cavity, the central cavity having vertical sides and a round base, the thicker part further comprising two side cavities on two sides of the central cavity, the side cavities each comprising a round stub on its far wall toward the edge of the device, the side cavities each further comprising partial top and bottom wall protrusions from the cavity base, the protrusions controlling the movement of two independent gripping members for gripping the fabric roll shaft, the gripping members located one each for each side and further comprising three parts: a vertical wall located outside of the side cavity, a top extension positioned above the side cavity and a horizontal extension located inside the side cavity, the vertical wall having a flat face toward the side cavity and rounded face toward the central cavity, the horizontal extension comprising a rounded stub end, the stub end facilitating the mounting of a spring between itself and the round stub on the far wall of the side cavity, the spring ensuring the gripping member is pushed toward the central cavity in the dormant state of the dispenser, the base plate having an assortment of holes, the holes matching in configuration and in count an assortment of pins on the back of the cover, the pins facilitating snug mounting of the cover onto the base plate covering the side cavities, the cover having enough internal spacing over the gripping members so as to not hinder their free movement inside the side cavities.

5. The dispenser of claim 1 wherein an attachment device provides a system for mounting the free end of the roll shaft after its other end has been mounted on the bracket device mentioned above, the attachment device having a hole on one face and a stub of desired shaped on the other, the stub having a configuration matching the configuration of a hole in the body of a sprocket for attaching to it, the sprocket being aligned with the circular guide on the inner face of the exterior wall inside the wall compartment, the sprocket comprising circular rings on its back face to aid its seating and mounting on the circular guide, the sprocket further comprising several radial pins protruding out of its outer circumference that match the teeth of a gravity-actuated unidirectional gear system which, when activated, rotates the sprocket and thereby rotate the attachment device and through it further rotate the roll shaft such that the roll then dispenses the web, the attachment device further comprising a rotatable arm that closes the hole enclosing the roll shaft end once the latter is mounted inside the hole, the rotatable arm comprising a head end for providing a hold to move it.

6. The dispenser of claim 1 wherein the encasement cover having a container tray with a base and multiple rotatable enclosure flaps, the base is integrated with the encasement cover or is attached as an external body to the cover, the enclosure flaps comprising rotatable round extensions on two sides of their bottom, the extensions mounted in round holes in body of its base, the extensions acting as axis for rotation of the flaps, the flaps are opened by the user for placing objects, the flaps are further closed down on the base when not in use.

7. The dispenser of claim 1 wherein the roll shaft comprises a long shaft with a round cross-section that respectively matches the length and the inner diameter of the fabric roll, the shaft comprising two detachable halves along its long axis named lower half and upper half herein, the lower half comprising a square pin head at one end, the first end, aligned along the long axis of the encasement; the pin head at the first end further comprising a shape such that it fits snugly in the attachment device cavity, the upper half comprising a cut at the first end, that facilitates the snug placement of the upper half on to the lower half, the lower half further comprising three square boxes: one near the second end, opposite to the first end of the shaft and two on two opposite sides in the middle of the shaft, the boxes each comprising two side walls, a roof and a back wall but no front wall, the boxes each having a round stub on the back wall inside the box, the round stub in the box at the second end of the shaft axially aligned with the long axis of the shaft, the round stubs in the boxes in the middle of the shaft aligned perpendicular to the axis of the shaft, the lower half comprising a semicircular opening at the second end of the shaft and aligned with its long axis, the semicircular opening having a round lip around it outside the body of the shaft, the semicircular opening also having its counterpart opening on the upper half so as to form a complete round opening with a round lip when the upper half is placed on to the lower half, the stub at the second end of the lower half comprising a spring axially mounted on it, the spring having its other end axially mounted on a round stub on the back of a freestanding circular pin, the circular pin having a size that allows it to glide through the circular opening at this second end when two halves of the shaft are joined together, the circular pin further having two or more walls around the spring, the walls parallel the walls of a cavity at the second end of the shaft such that they allow the pin to move back and forth along the axis of the spring, the boxes on the two sides of the shaft each also having a spring mounted on the stub on its back wall, the spring each having its other end mounted on a round stub at the center of a flat plate, the flat plate having its two ends bent so as to facilitate its mounting into two corresponding cavities located on two sides of each of the middle boxes in each half of the shaft, the flat plate comprising a square box around the stub mounted spring, the square box having a size such that it glides smoothly in and out of its corresponding box one on each side of the shaft, the lower or upper half comprising a number of sockets inside the shaft with corresponding projections acting as inserts on the corresponding other half for enduringly attaching the two halves together, the lower or upper half each containing a hollow channel in the middle along its length for weight reduction.

8. The dispenser of claim 1 wherein the encasement comprises a handle at its front that provides the a system for rotating the roll shaft, the handle being positioned parallel to the front face of the dispenser in the horizontal plane, the handle comprising a plate in the middle of the handle, the handle further comprising grooved ends one each at each end of the handle, the middle part being positioned lower than the two ends of the handle, the handle ends each comprising uneven shaped continuation between itself and the middle part, the handle grooved ends providing the implement to attach the handle to the corresponding gear train lever ends at each of the two ends of the handle.

* * * * *